US007518108B2

(12) United States Patent
Frey et al.

(10) Patent No.: US 7,518,108 B2
(45) Date of Patent: Apr. 14, 2009

(54) ELECTROSPRAY IONIZATION ION SOURCE WITH TUNABLE CHARGE REDUCTION

(75) Inventors: Brian L. Frey, Madison, WI (US); Lloyd M. Smith, Madison, WI (US); Michael S. Westphall, Fitchburg, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 400 days.

(21) Appl. No.: 11/272,450

(22) Filed: Nov. 10, 2005

(65) Prior Publication Data

US 2007/0102634 A1 May 10, 2007

(51) Int. Cl.
*B01D 59/44* (2006.01)
*H01J 49/00* (2006.01)

(52) U.S. Cl. ..... 250/288; 250/281

(58) Field of Classification Search ..... 250/288, 250/281, 292

See application file for complete search history.

(56) References Cited

U.S. PATENT DOCUMENTS 3,226,543 A 12/1965 Smith et al.
3,683,212 A 8/1972 Zoltan
3,857,049 A 12/1974 Zoltan
4,352,570 A 10/1982 Firth
4,357,536 A 11/1982 Varma et al.
4,383,171 A 5/1983 Sinha et al.
4,461,155 A 7/1984 Werjefelt
4,492,322 A 1/1985 Hieftje et al.
4,546,253 A * 10/1985 Tsuchiya et al. ..... 250/288
4,579,279 A 4/1986 Marchant
4,580,148 A 4/1986 Domoto et al.
4,735,364 A 4/1988 Marchant
4,761,545 A 8/1988 Marshall et al.
4,762,995 A 8/1988 Browner et al.
4,845,512 A 7/1989 Arway
4,883,958 A 11/1989 Vestal
4,924,097 A 5/1990 Browner et al.
4,935,624 A 6/1990 Henionn et al.
4,960,991 A * 10/1990 Goodley et al. ..... 250/281
4,999,493 A 3/1991 Allen et al.
5,073,713 A 12/1991 Smith et al.

(Continued)

FOREIGN PATENT DOCUMENTS

WO 0017908 3/2000

OTHER PUBLICATIONS

Allison et al. (1996) "Cubic Electrodynamic Levitation Trap with Transparent Electrodes," Rev. Sci. Instrum. 37 (11):3806-3812.

(Continued)

*Primary Examiner*—Nikita Wells
*Assistant Examiner*—Johnnie L Smith, II
(74) *Attorney, Agent, or Firm*—Greenlee, Winner and Sullivan, P.C.

(57) ABSTRACT

This invention provides methods, devices and device components for preparing ions from liquid samples containing chemical species and methods and devices for analyzing chemical species in liquid samples. The present invention provides an ion source for generating analyte ions having a selected charge state distribution, such as a reduced charged state distribution, that may be effectively interfaced with a variety of charged particle analyzers, including virtually any type of mass spectrometer.

22 Claims, 7 Drawing Sheets

U.S. PATENT DOCUMENTS 5,076,097 A 12/1991 Zarrin et al.
5,192,865 A 3/1993 Zhu
5,247,842 A 9/1993 Kaufman et al.
RE34,757 E 10/1994 Smith et al.
5,359,196 A 10/1994 Whitt
5,403,617 A 4/1995 Haaland
5,448,062 A 9/1995 Cooks et al.
5,475,228 A 12/1995 Palathingal
5,504,327 A 4/1996 Sproch et al.
5,560,543 A 10/1996 Smith et al.
5,565,677 A 10/1996 Wexler et al.
5,591,969 A 1/1997 Park et al.
5,608,217 A 3/1997 Franzen et al.
5,611,846 A 3/1997 Overton et al.
5,614,711 A 3/1997 Li et al.
5,625,186 A 4/1997 Frankevich et al.
5,663,561 A 9/1997 Franzen et al.
5,750,988 A * 5/1998 Apffel et al. ..... 250/288
5,767,512 A 6/1998 Eiden et al.
5,770,857 A 6/1998 Fuerstenau et al.
5,811,800 A 9/1998 Franzen et al.
5,838,002 A * 11/1998 Sheehan ..... 250/288
5,873,523 A 2/1999 Gomez et al.
5,880,466 A 3/1999 Benner
5,894,841 A 4/1999 Voges
5,922,976 A 7/1999 Russell et al.
5,925,732 A 7/1999 Ecker et al.
5,945,678 A * 8/1999 Yanagisawa ..... 250/423 F
5,965,883 A 10/1999 Lee et al.
5,973,904 A 10/1999 Pii et al.
5,992,244 A 11/1999 Pui et al.
5,994,694 A 11/1999 Frank et al.
6,001,309 A 12/1999 Gamble et al.
6,027,699 A 2/2000 Holcomb et al.
6,051,189 A 4/2000 Wick et al.
6,093,557 A 7/2000 Pui et al.
6,107,623 A 8/2000 Bateman et al.
6,107,628 A 8/2000 Smith et al.
6,137,112 A 10/2000 McIntyre et al.
6,147,345 A * 11/2000 Willoughby ..... 250/288
6,188,066 B1 2/2001 Whitehouse et al.
6,207,954 B1 3/2001 Andrien et al.
6,277,334 B1 8/2001 Ecker et al.
6,278,111 B1 * 8/2001 Sheehan et al. ..... 250/288
6,331,702 B1 12/2001 Krutchinsky et al.
6,359,275 B1 3/2002 Bertsch et al.
6,396,057 B1 5/2002 Jarrell et al.
6,469,295 B1 10/2002 Park
6,593,570 B2 7/2003 Li et al.
6,649,907 B2 * 11/2003 Ebeling et al. ..... 250/288
6,727,471 B2 4/2004 Evans et al.
6,727,497 B2 4/2004 Scalf et al.
6,784,421 B2 8/2004 Park
6,787,764 B2 9/2004 Park
6,797,945 B2 9/2004 Berggren et al.
6,815,668 B2 11/2004 Miller et al.
6,828,572 B2 12/2004 Reece et al.
6,831,280 B2 12/2004 Scherer
6,906,322 B2 6/2005 Berggren et al.
7,022,981 B2 * 4/2006 Kato ..... 250/288
7,253,405 B2 * 8/2007 Kato ..... 250/288
2001/0028866 A1 10/2001 Ecker et al.
2001/0035494 A1 * 11/2001 Scalf et al. ..... 250/288
2002/0125423 A1 * 9/2002 Ebeling et al. ..... 250/288
2002/0166958 A1 * 11/2002 Afeyan et al. ..... 250/282
2004/0219695 A1 11/2004 Fox
2006/0124847 A1 * 6/2006 Kato ..... 250/288
2006/0255261 A1 * 11/2006 Whitehouse et al. ..... 250/288

OTHER PUBLICATIONS

Benner, W.H. (1997) "A Gated Electrostatic Ion Trap to Repetitiously Measure the Charge and m/z of Large Electrospray Ions," Anal. Chem. 69:4162-4168.
Busman et al. (1991) "Space-Charge-Dominated Mass-Spectrometry Ion Sources—Modeling and Sensitivity," J. Am. Soc. Mass Spectrum. 2:1-10.
Carroll et al. (1981) "Atmospheric-Pressure Ionization Mass-Spectrometry," Appl. Spectrosc. Rev. 17:337-406.
Chen et al. (2003) "Mass Spectrometric Analysis of DNA Mixtures: Instrumental Effects Responsible for Decreased Sensitivity with Increasing Mass," Anal. Chem. 75:5944-5952.
Chen et al. (1995) "Electrospraying of Conducting Liquids for Monodisperse Aerosol Generation in the 2 nm to 1.8 μm Diameter range," J. Aerosol. Sci. 26:963-977.
Cheng et al. (1995) "Charge State Reduction of Oligonucleotide Negative Ions from Electrospray Ionization," Anal. Chem. 67(3):586-593.
Comisarow, M.B. (1978) "Signal Modeling for Ion Cyclotron Resonance," J. Chem. Phys. 96(9):4097-4104.
Cooper et al. (1973) "Neutralizing Charged Aerosols with Radioactive Sources," J. Colloid Interface Sci. 45:17-26.
Dahneke et al. (1972) "An Aerosol Beam Spectrometer," Aerosol Sci. 3:345-349.
Diedrich et al. (1987) "Nonclassical Radiation of a Single Stored Ion," Physical Rev. Lett. 58(3):203-206.
Ebeling et al. (2000) "Corona Discharge in Charge Reduction Electrospray Mass Spectrometry," Anal. Chem. 72:5158-5161.
Ebeling et al. (2001) "A Cylindrical Capacitor Ionization Source: Droplet Generation and Controlled Charge Reduction for Mass Spectrometry," Rapid Commun. Mass Spectrom. 15:401-405.
Ebeling, D. (2000) "Development of Corona Discharge Reduction Electrospray Mass Spectrometry for Analysis of DNA Sequencing Reactions," Research Proposal, University of Wisconsin-Madison, 15pp.
Feng et al. (2000) "Single Isolated Droplets with Net Charge as a Source of Ions," Am. Soc. Mass Spec. 11:393-399.
Fenn et al. (1989) "Electrospray Ionization for Mass-Spectrometry of Large Biomolecules," Science 246:64-71.
Fenn et al. (1990) "Electrospray Ionization—Principles and Practice," Mass. Spec. Rev. 9:37-70.
Fuerstenau et al. (1995) "Molecular Weight Determination of Megadalton DNA Electrospray Ions Using Charge Detection Time-of-Flight Mass Spectrometry," Rapid Commun. Mass Spectrom. 9:1528-1538.
Gajewski, J.B. (1984) "Mathematical Model of Non-Contact Measurements of Charges While Moving," J. Electrostatics 15:81-92.
Galley et al. (1992) "Technique for Producing Capillaries with Reproducible Orifice Diameters for Uniform Droplet Generation," Appl. Spectrosc. 46(10):1460-1463.
Geno et al. (1989) "Secondary-Electron Emission Induced by Impact of Low-Velocity Molecular-Ions on a Microchannel Plate," Int. J. Mass Spectrom. Ion Processes 92:195-210.
Georghiou et al. (1999) "Characterization of Point-Plane Corona in Air at Radio Frequency Using a FE-FCT Method," J. Phys. D.: Appl. Phys. 32:2204-2218.
Griffey et al. (1997) "Oligonucleotide Charge States in Negative Ionization Electrospray-Mass Spectrometry are a Function of Solution Ammonium Ion Concentration," J. Am. Soc. Mass Spectrom. 8:155-160.
Guilhaus et al. (2000) "Orthogonal Acceleration Time-of-Flight Mass Spectrometry," Mass Spectrom. Rev. 19:65-107.
Hayter et al. (2003) "Proteome Analysis of Intact Proteins in Complex Mixtures," Mol. Cell. Proteomics 2:85-95.
Hager et al. (1994) "Droplet Electrospray Mass Spectrometry," Anal. Chem. 66(22):3944-3949.
He et al. (1999) "337 nm Matrix-Assisted Laser Desorption/Ionization of Single Aerosol Particles," J. Mass Spectrom. 34:909-914.
He et al. (2004) "Charge Permutation Reactions in Tandem Mass Spectrometry," J. Mass Spectrom. 39:1231-1259.

Hillenkamp et al. (1991) "Matrix-Assisted Laser Desorption Ionization Mass-Spectrometry of Biopolymers," Anal. Chem. 63(24):1193A-1203A.
Houston, P.L. (2001) "The Rates of Chemical Reactions," In; Chemical Kinetics and Reaction Dynamics, McGraw-Hill; Boston, pp. 34-47.
Huang et al. (1990) "Atmospheric Pressure Ionization Mass Spectrometry," Anal. Chem. 62(13):713A-725A.
Ikonomou et al. (1992) "An Ion-Source With Which Ions Produced By Electrospray Can Be Subjected to Ion Molecule Reactions at Intermediate Pressure (10-100 Torr)—Deprotonation of Polyprotonated Peptides," Int. J. Mass Spectrom. Ion Processes 117:283-298.
Karas et al. (1988) "Laser Desorption Ionization of Proteins with Molecular Masses Exceeding 10,000 Daltons," Anal. Chem. 60:2299-2306.
Karas et al. (1987) "Matrix-Assisted Ultraviolet-Laser Desorption of Nonvolatile Compounds," Int. J. Mass Spectrom. Ion Processes 78:53-68.
Kaufman et al. (1996) "Macromolecule Analysis Based on Electrophoretic Mobility in Air: Globular Proteins," Anal. Chem. 68:3703.
Kaufman et al. (1996) "Macromolecule Analysis Based on Electrophoretic Mobility in Air: Globular Proteins," Anal. Chem. 68:1895-1904.
Kaufman, S.L. (1998) "Analysis of Biomolecules Using Electrospray and Nanoparticle Methods: The Gas-Phase Electrophoretic Mobility Molecular Analyzer (GEMMA)," J. Aerosol. Sci. 29(5-6):537-552.
Kaufman et al. (1998) "Analysis of a 3.6-MDa Hexagonal Bilayer Hemoglobin from Lumbricus terrestris Using Gas-Phase Electrophoretic Mobility Molecular Analyzer," Anal. Biochem. 259:195-202.
Kaufman, S.L. (2000) "Electrospray Diagnostics Performed by Using Sucrose and Proteins in the Gas-Phase Electrophoretic Mobility Molecular Analyzer (GEMMA)," Anal. Chim. Acta 406:3-10.
Kim et al. (2000) "Design and Implementation of a New Electrodynamic Ion Funnel," Anal. Chem. 71(10):2247-2255.
Kim et al. (2000) "Improved Ion Transmission from Atmospheric Pressure to High Vacuum Using a Multicapillary Inlet and Electrodynamic Ion Funnel Interface," Anal. Chem. 72(20):5014-5019.
Kung et al. (1999) "Single-Molecule Analysis of Ultradilute Solutions with Guided Streams of 1-μm Water Droplets," Appl. Optics 38(9):1481-1487.
Lazar et al. (2000) "Electrospray Ionization Time-of-Flight Mass Spectrometric Detection for Fast Liquid Phase Separations," Am. Laboratory :110-119.
Lee et al. (2002) "Direct Mass Spectrometric Analysis of Intact Proteins of the Large Ribosomal Subunit Using Capillary LC/FTICR," Proc. Natl. Acad. Sci. USA 99:5942-5947.
Lennon et al. (1996) "Strategy for Pulsed Ionization Methods on a Sector Mass Spectrometer," Anal. Chem. 68:845-849.
Li et al. (1999) "Identification of Intact Proteins in Mixtures by Alternated Capillary Liquid Chromatography Electrospray Ionization and LC ESI Infrared Multiphoton Dissociation Fourier Transform Ion Cyclotron Resonance Mass Spectrometry," Anal. Chem. 71:4397-4402.
Likharev, K.K. (1999) "Single-Electron Devices and Their Applications," Proc. IEEE 87(4):606-632.
Limbach, P.A. (1996) "Indirect Mass Spectrometric Methods for Characterizing and Sequencing Oligonucleotides," Mass Spectrom. Rev. 15:297-336.
Liu et al. (1995) "Generating Particle Beams of Controlled Dimensions and Divergence: II. Experimental Evaluation of Particle Motion in Aerodynamic Lenses and Nozzle Expansions, " Aerosol Sci. Technol. 22:314-324.
Liu et al. (1995) "Generating Particle beams of Controlled Dimensions and Divergence: I. Theory of Particle Motion in Aerodynamic Lenses and Nozzle Expansions," Aerosol. Sci. Technol. 22:293-313.
Loeb, L. B. (1948) "Recent Developments in Analysis of the Mechanisms of Positive Coronas in Air," J. Appl. Phys. 19:882-897.
Loo et al. (1994) "Investigation of the Gas-Phase Structure of Electrosprayed Proteins Using Ion-Molecule Reactions," J. Am. Soc. Mass Spectrom. 5:207-220.
Lu et al. (2004) "Corona Discharge Neutralizer for Electrospray Aerosols Used with Condensation Nucleation-Light-Scattering Detection," Anal. Chem. 76:5539-5546.
Luginbuhl et al. (2000) "Femtoliter Injector for DNA Mass Spectrometry," Sensors and Actuators B 63:167-177.
Maleknia et al. (1999) "Millisecond Radiolytic Modification of Peptides by Synchrotron X-Rays Identified by Mass Spectrometry," Anal. Chem. 71:3965-3973.
Maleknia et al. (1999) "Electrospray-Assisted Modification of Proteins: A Radical Probe of Protein Structure," Rapid Commun. Mass Spectrom. 13:2352-2358.
Mann et al. (1989) "Interpreting Mass Spectra of Multiply Charged Ions," Anal. Chem. 62:1702-1708.
Marshall et al. (1982) "Measurements of Charged Precipitation in a New Mexico Thunderstorm: Lower Positive Charge Centers," J. Geophysical Res. 87(C9):7141-7157.
McLuckey et al. (1998) "Ion/Ion Chemistry of High-Mass Multiply Charged Ions," Mass. Spectrom. Rev. 17:369-407.
McLuckey et al. (1990) "Reactions of Dimethylamine with Multiply Charged Ions of Cytochrome-C," J. Am. Chem. Soc. 112:5668-5670.
McLuckey et al. (1998) "Ion/Ion Proton-Transfer Kinetics: Implications for Analysis of Ions Derived from Electrospray of Protein Mixtures," Anal. Chem. 70:1198-1202.
Meng et al. (2002) "Processing Complex Mixtures of Intact Proteins for Direct Analysis by Mass Spectrometry," Anal. Chem. 74:2923-2929.
Miliotis et al. (2000) "Capillary Liquid Chromatography Interfaced to Matrix-Assisted Laser Desorption/Ionization Time-of Flight Mass Spectrometry Using an On-Line Coupled Piezoelectric Flow-Through Microdispenser," J. Mass Spectrom. 35:369-377.
Mirza et al. (1994) "Effects of Anions on the Positive Ion Electrospray Ionization Mass Spectra of Peptides and Proteins," Anal. Chem. 66:2898-2904.
Mouradian, S. (1998) "Separation and Detection of Nucleic Acids," Ph.D. Thesis, Chemistry, University of Wisconsin-Madison.
Mouradian et al. (1997) "DNA Analysis Using An Electrospray Scanning Mobility Particle Sizer," Anal. Chem. 69:919-925.
Nikolaev et al. (2004) "Trace Analysis of Organics in Air by Corona Discharge Atmospheric Pressure Ionization Using an Electrospray Ionization Interface," Eur. J. Mass Spectrom. 10:197-204.
Ogorzalek et al. (1992) "A New Approach for the Study of Gas-Phase Ion-Ion Reactions Using Electrospray Ionization," J. Am. Soc. Mass Spectrom. 3:695-705 J. Am. Soc. Mass Spectrom. 3:695-705.
Park et al. (1994) "An Inductive Detector for Time-of-Flight Mass Spectrometry," Rapid Commun. Mass Spectrom. 8:317-322.
Pitteri et al. (2005) "Recent Development in the Ion/Ion Chemistry of High-Mass Multiply Charged Ions," Mass. Spectrom. Rev. Published online.
Reid et al. (2002) "Gas-Phase Concentration, Purification, and Identification of Whole Proteins from Complex Mixtures," J. Am. Chem. Soc. 124:7353-7362.
Roos et al. (1990) "Observation of the Interaction Between Artificially Activated Particles and Insulating Surfaces," J. Aerosol Sci. 21(supp. 1):S131-S134.
Sarkissian et al. (2000) "Measurement of Phenyllactate, Phenylacetate, and Phenylpyruvate by Negative Ion Chemical Ionization-Gas Chromatography/Mass Spectrometry in Brain of Mouse Genetic Models of Phenylketonuria and Non-Phenylketonuria Hyperphenylalaninemia," Anal. Biochem. 280:242-249.
Scalf et al. (1999) "Controlling Charge State of Large Ions," Science 283:194-197.
Scalf et al. (2000) "Charge Reduction Electrospray Mass Spectrometry," Anal. Chem. 72:52-60.
Schneider et al. (2003) "Particle Discriminator Interface for Nanoflow ESI-MS," J. Am. Soc. Mass Spectrom. 14:1236-1246.
Schultz et al. (1999) "Polymerase Chain Reaction Products Analyzed by Charge Detection Mass Spectrometry," Rapid Commun. Mass Spectrom. 13:15-20.

Schultz et al. (1998) "Mass Determination of Megadalton-DNA Electrospray Ions Using Charge Detection Mass Spectrometry," J. Am. Soc. Mass Spectrom. 9:305-313.
Seinfeld et al. (1998) "Chemistry of the Troposphere," In; Atmospheric Chemistry and Physics: From Air Pollution to Climate Change, Wiley, New York, pp. 234-336.
Shaw et al. (199) "An Electrodynamic Levitation System for Studying Individual Cloud Particles Under Upper-Tropospheric Conditions," J. Atmospheric Ocean Tech. 17(7):940-948.
Skalny et al. (2004) "An Analysis of Mass Spectrometric Study of Negative Ions Extracted from Negative Corona Discharge in Air," Int. J. Mass Spectrom. 233:317-324.
Smith et al. (1991) "Principals and Practice of Electrospray Ionization—Mass-Spectrometry for Large Polypeptides and Proteins," Mass Spectrom. Rev. 10:359-451.
Smith et al. (1994) "Trapping Detection and Reaction of Very Large Single Molecular-Ions by Mass-Spectrometry," Nature 369:137-139.
Smith, L.M (1996) "Sequence from Spectrometry: A Realistic Prospect," Nature Biotechnol. 14:1064-1065.
Smith et al. (1990) "New Developments in Biochemical Mass Spectrometry: Electrospray Ionization," Anal. Chem. 62:882-899.
Steenberg et al. (2001) "Inductive and Capacitive Sensor Arrays for in Situ Composition Sensors," Aerospace Conference, IEEE Proceedings, Mar. 10-17, vol. 1, pp. 1-299-1/309.
Stephenson et al. (1997) "Gaseous Protein Cations are Amphoteric," J. Am Chem. Soc. 119-1688-1696.
Stephenson et al. (1998) "Ion/Ion Reactions for Oligopeptide Mixture Analysis: Application to Mixtures Comprised of 0.5-100kDa Components," J. Am Soc. Mass. Spectrom. 9:585-596.
Stephenson et al. (1996) "Ion/Ion Reactions in the Gas Phase: Proton Transfer Reactions Involving Multiply-Charged Proteins," J. Am. Chem. Soc. 118:7390-7397.
Stephenson et al. (1997) "Ion-Ion Proton Transfer Reactions of Bio-Ions Involving Noncovalent Interactions: Holomyoglobin," J. Am. Soc. Mass Spectrom. 8:637-644.
Stephenson et al. 91998) "Charge Manipulation for Improved Mass Determination of High-Mass Species and Mixture Components by Electrospray Mass Spectrometry," J. Mass Spectrom. 33:664-672.
Stephenson et al. (1996) "Ion/Ion Proton Transfer Reactions for Protein Mixture Analysis," Anal. Chem. 68:4026-4032.
Stephenson et al. (1998) "Simplification of Product Ion Spectra Derived from Multiply Charged Parent Ions Via Ion/Ion Chemistry," Anal. Chem. 70:3533-3544.
Stradling et al. (1993) "Ultra-High Velocity Impacts: Cratering Studies of Microscopic Impacts from 3 KM/S to 30 KM/S," Int. J. Impact Eng.:719-727.
Switzer, G.L. (1991) "A Versatile System for Stable Generation of Uniform Droplets," Rev. Sci. Instrum. 62 (11):2765-2771.
Tanner et al. (1994) "Gas and Ion Dynamics of a 3-Aperture Vacuum Interface for Inductively-Coupled Plasma-Mass Spectrometry," Appl. Spectrosc. 48:1373-1378.
Tsi Incorporated, Particle Instrument Division (1999) "GEMMA Method for Macromolecule/Nanoparticle Analysis," Downloaded May 13, 2000, http://www.tsi.com/particle/product/gemme/gemma.html.
TSI Incorporated Particle Instruments (1998) "Model 3480 Electrospray Aerosol Generator,".
TSI Incorporated Particle Instruments(1999) "Model 3800 Aerosol Time-of-Flight Mass Spectrometer,".
TSI Incorporated Particle Instruments (1997) "TSI Working Prototype GEMMA* Macromolecule Analyzer," TSI Incorporated Advanced Technology Group.
Vercoulen et al. (199) "An Instrument for Measuring Electric Charge on Individual Aerosol Particles," J. Aerosol. Sci. 22(supp. 1):S335-S338.
Wang et al. (1998) "Ionization Within a Cylindrical Capacitor: Electrospray Without An Externally Applied High Voltage," Anal. Chem. 70(2):205-212.
Weinheimer, A.J. (1988) "The Charge Induced on a Conducting Cylinder by a Point Charge and Its Application to the Measurement of Charge on Precipitation," J. Atmospheric Oceanic Tech. 5:298-304.
Westmacott et al. (2000) "Using Superconducting Tunnel Juction Detector to Measure the Secondary Electron Emission Efficiency for a Microchannel Plate Detector Bombarded by Large Molecular Ions," Rapid Commun. Mass Spectrom. 14:1854-1861.
Wong et al. (2003) "Study of the Ribonuclease-S-Protein-Peptide Complex Using a Radical Probe and Electrospray Ionization Mass Spectrometry," Anal. Chem. 75:1557-1563.
Yamashita et al. (1984) "Negative-Ion Production with the Electrospray Ion-Source," J. Phys. Chem. 88:4671-4675.
Yates, J.R. III (1998) "Mass Spectrometry and the Age of the Proteome," J. Mass Spectrom. 33:1-19.

* cited by examiner

ELECTROSPRAY IONIZATION ION SOURCE WITH TUNABLE CHARGE REDUCTION

STATEMENT REGARDING FEDERALLY SPONSORED RESEARCH OR DEVELOPMENT

This invention was made with United States government support awarded by the following agencies: NIH Grants: HG001808 and HV028182. The United States has certain rights in this invention.

CROSS REFERENCE TO RELATED APPLICATIONS

Not applicable

BACKGROUND OF THE INVENTION

Mass spectrometry has advanced over the last few decades to the point where it is one of the most broadly applicable analytical tools for detection and characterization of a wide class of molecules. Mass spectrometric analysis is applicable to almost any species capable of forming an ion in the gas phase, and, therefore, provides perhaps the most universally applicable method of quantitative analysis. In addition, mass spectrometry is a highly selective technique especially well suited for the analysis of complex mixtures of different compounds in varying concentrations. Further, mass spectrometric methods provide very high detection sensitivities, approaching tenths of parts per trillion for some species. As a result of these beneficial attributes, a great deal of attention has been directed over the last several decades at developing mass spectrometric methods for analyzing complex mixtures of biomolecules, such as peptides, proteins, carbohydrates and oligonucleotides and complexes of these molecules.

To be detectable via mass spectrometric methods, a compound of interest must first be converted into an ion in the gas phase. Accordingly, the ion formation process significantly impacts the scope, applicability, efficiency and limitations of mass spectrometry. Conventional ion preparation methods for mass spectrometric analysis are largely unsuitable for high molecular weight compounds, such as biomolecules. For example, vaporization by sublimation and/or thermal desorption is unfeasible for many high molecular weight biomolecules because these species tend to have negligibly low vapor pressures. Ionization methods based upon desorption processes, on the other hand, have proven more effective in generating ions from thermally labile, nonvolatile compounds. In these methods, a sample is subjected to conditions resulting in emission of ions from solid or liquid surfaces or generation of ions via complete evaporation of charged droplets.

Over the last few decades, two desorption based ion preparation techniques have been developed that are particularly well suited for the analysis of large molecular weight compounds: (1) matrix assisted laser desorption and ionization—mass spectrometry (MALDI-MS) and (2) electrospray ionization—mass spectrometry (ESI-MS). MALDI and ESI ion preparation methods have profoundly expanded the role of mass spectrometry for the analysis of nonvolatile high molecular weight compounds including many compounds of biological interest. These ionization techniques generally provide high ionization efficiencies (ionization efficiency=(ions formed)/(molecules consumed)) and have been demonstrated to be applicable to biomolecules with molecular weights exceeding 100,000 Daltons.

In MALDI, analyte is integrated into a crystalline organic matrix and irradiated by a short (≈10 ns) pulse of laser radiation at a wavelength resonant with the absorption band of the matrix molecules. This process results in rapid formation of a gas phase plume wherein analyte molecules are entrained and ionized via gas-phase proton transfer reactions. MALDI ion formation generally produces ions in singly and/or doubly charged states. Fragmentation of analyte molecules during vaporization and ionization, however, limits the applicability of MALDI for some samples, and the sensitivity of the technique is known to depend on sample preparation methodology and the surface and bulk characteristics of the site irradiated by the laser. As a result, MALDI-MS analysis is primarily used to identify the molecular masses of components of a sample and yields little information pertaining to the concentrations or molecular structures of materials analyzed. Further, MALDI ion sources are generally not directly compatible with systems useful for online sample purification prior to ion formation, such as capillary electrophoresis and high performance liquid chromatography systems.

ESI is a widely used field desorption ionization method that generally provides a means of generating gas phase ions with little analyte fragmentation [Fenn et al., Science, 246, 64-70 (1989)]. Furthermore, ESI is directly compatible with on-line liquid phase separation techniques, such as high performance liquid chromatography (HPLC) and capillary electrophoresis systems. In ESI, a solution containing a solvent and an analyte is pumped through a capillary orifice maintained at a high electrical potential and directed at an opposing plate provided near ground. The electric field at the capillary tip charges the surface of the emerging liquid and results in a continuous or pulsed stream of electrically charged droplets. Subsequent evaporation of the solvent from charged droplets promotes formation of analyte ions from species existing as ions in solution. Polar analyte species may also undergo desorption and/or ionization during the electrospray process by associating with cations and anions in solution. A number of other useful field desorption methods using electrically charged droplets have been developed in recent years that are also capable of preparing ions from non-volatile, thermally liable, high molecular weight compounds. These techniques differ primarily in the physical mechanism in which droplets are generated and electrically charged, and include aerospray ionization, thermospray ionization and the use of pneumatic nebulization.

In contrast to MALDI, ions produced by field desorption methods employing charged droplets typically generate analyte ions populating a number of different multiply charged states, including highly charged states. Mass spectra obtained using these techniques, therefore, may comprise a complex amalgamation of peaks corresponding to a distribution of multiply charged states for each analyte species in a sample. In some cases, mass spectra obtained using these techniques have too many overlapping peaks to allow effective discrimination and identification of the components of a sample comprising a complex mixture of analytes. Accordingly, the formation of analyte ions populating a relatively a large number of different multiply charged states limits the applicability of field desorption ionization methods employing electrically charged droplets for analysis of complex mixtures, such as samples obtained from cell lysates.

Over the last decade, various computational and experimental approaches for expanding the utility of ESI-MS techniques for the analysis of complex mixtures of biopolymers have been pursed. One approach uses computer algorithms that transform experimentally derived multiply charged ESI spectra to "zero charge" spectra [Mann et al., Anal. Chem., 62, 1702 (1989)]. While transformation algorithms take advantage of the precision improvement afforded by multiple peaks attributable to the same analyte species, spectral complexity, detector noise and chemical noise often result in missed analyte peaks and the appearance of false, artifactual peaks. The utility of transformation algorithms for interpreting ESI-MS spectra of mixtures of biopolymers may be substantially improved, however, by manipulating the charge-state distribution of analyte ions produced in ESI and/or by operating under experimental conditions providing high signal to noise ratios [Stephenson and McLucky, J. Mass Spectrom. 33, 664-672 (1998)]. Another approach to reducing the complexity of ESI-MS spectra of mixtures of biopolymers involves operating the electrospray ionization ion source in a manner that lowers and/or controls the net number of charge-states populated for a particular analyte compound. A variety of methods of charge reduction have been attempted with varying degrees of success.

Griffey et al. report that the charge-state distribution of analyte ions produced by ESI may be manipulated by adjusting the chemical composition of the solution discharged by the electrospray [Griffey et al., J. Am. Soc. Mass Spectrom., 8, 155-160 (1997)]. They demonstrate that modification of solution pH and/or the abundance of organic acids or bases in a solution may result in ESI-MS spectra for oligonucleotides primarily consisting of singly and doubly charged ions. In particular, Griffey et al. report a decrease in the average charge-state observed for the electrospray of solutions of a 14 mer DNA molecule from −7.2 to −3.8 upon addition of ammonium acetate to achieve a concentration of approximately 33 mM. Although in some cases altering solution conditions appears to improve the ease in which ESI spectra are interpreted, these techniques do not allow selective control over the distribution of charge states accessed for all species present in solution. In addition, manipulation of solution phase composition may also generate unwanted effects, such as compromising ionization and/or transmission efficiencies in the electrospray ionization process.

An alternative approach for controlling the charge-state distributions of analyte ions produced by ESI is involves the use of gas phase chemical reactions of reagent ions to reduce the ionic charges of droplets and/or analyte ions generated upon electrospray discharge. This approach has the advantage of at least partially decoupling ionization and charge reduction processes in a manner having the potential to provide substantially independent control of charge-state distribution. Independent control of charge reduction is beneficial as it provides flexibility in selecting the sample composition (e.g. pH, buffer concentration, ionic strength etc.) and the ESI operating conditions.

To achieve a reduction in the charge-state distribution generated in the electrospray discharge of a solution containing a mixture of proteins, Ogorzalek et al. merged the output of an electrospray discharge with a stream of reagent ions generated by an externally housed Corona discharge [Ogorzalek et al., J. Am. Soc. Mass Spectrom., 3, 695-705 (1992)]. Ogorzalek et al. observed a decrease in the most abundant cation observed in the electrospray discharge of solutions containing equine heart cytochrome c from a charge state of +15 to a charge state of +13 upon merging a stream of anions formed via corona discharge with the output of an ESI source operating in positive ion mode. While the authors report a measurable reduction in analyte ion charge state distribution, generation of a population consisting predominantly of singly and/or doubly charged ions was not achievable. Furthermore, the authors note that operation of the discharge at high discharge currents lead to a reduction in analyte ion signal equal to about two orders of magnitude. Regarding the potential application of their technique for "shifting charge state distributions," the authors indicated "[o]ur experience suggests that the ion-ion reactions studied to date for this purpose are not as easy to control and appear to lead to greater signal losses than do ion-molecule reactions."

U.S. Pat. No. 5,992,244 (Pui et al.) also report a method for neutralizing charged particles alleged to minimize particle losses to surfaces. In this method, charged droplets and/or particles are generated via electrospray and exposed to a stream of oppositely charged electrons and/or reagent ions flowing in a direction opposite to that of the electrospray discharge. The authors describe the use of a neutralization chamber with one or more corona discharges distributed along the housing for producing free electrons and/or ions for neutralizing the output of an electrospray discharge. Electrically biased, perforated metal screens or plates are positioned along the housing of the neutralization chamber between the corona discharges and a neutralization region to create a confined electric field to conduct reagent ions toward the electrospray discharge. In addition, Pui et al., describe a similar charged particle neutralization apparatus in which the corona discharge ion source is replaced with a radioactive source of ionizing radiation for generating reagent ions. In both methods, neutralization is reported to reduce wall losses and enhance neutral aerosol throughput to an optical detection region located downstream of the electrospray discharge.

U.S. Pat. Nos. 6,727,471 and 6,649,907 disclose methods, devices and device components providing charge reduction for field desorption ion sources using charged droplet, such as ESI and nebulization sources. In the patents, the output of a source of electrically charged droplets is directed through a field desorption-charge reduction chamber having a source of reagent ions. Reactions between charged droplets, analyte ions or both and oppositely charged reagent ions and/or electrons in the field desorption-charge reduction chamber reduces the charge state distribution of the analyte ions. The patents describe various means of improving high transmission efficiencies of analyte ions through the charge reduction chambers including use of a shield element surrounding the reagent ion source for substantially confining electric and/or magnetic fields generated by the reagent ion source, and use of a radioactive source of reagent ions. In addition, the patents provide various means for selectively adjusting the charge state distribution of reagent ions, including selective adjustment of the residence time of analyte ions and charged droplets in the field desorption-charge reduction chamber, selective adjustment of the voltage applied to a corona discharge reagent ion source, and selective adjustment of the flux of ionizing radiation generated by a radioactive ion source.

It will be appreciated from the foregoing that a need exists for devices and methods for regulating the charge-state distribution of ions generated by field desorption techniques to permit analysis of mixtures containing high molecular weight biopolymers via mass spectrometry. Particularly, methods, devices and device components are needed that provide selectively adjustable (i.e. tunable) charge reduction over a useful range of analyte ion charge states. Further, charge reduction methods and devices are needed that provide high analyte ion transmission and collection efficiencies required for sensitive mass spectrometric analysis.

SUMMARY OF THE INVENTION

The present invention provides methods and devices for generating gas phase ions from chemical species in liquid samples, including but not limited to chemical species having high molecular masses (e.g. molecular mass greater than 2000 Daltons). Ion sources of the present invention provide analyte ions having a reduced charge state distribution relative to conventional field desorption ion sources using electrically charged droplets. Methods, devices and device components of the present invention provide control of the charge state distribution of the gas phase ions generated, such as continuously selectable control of analyte ion charge state distribution, and provide a source of gas phase ions that may be coupled to a sensing or analysis system, such as a mass spectrometer, in a manner providing high analyte ion transmission and collection efficiency.

In one aspect, the present invention provides an ion source for generating analyte ions having a selected charge state distribution, including analyte ions having a charge state distribution that is reduced compared to the charge state distribution of ions generated using conventional field desorption methods employing charged droplets. In one embodiment, an ion source of the present invention comprises an electrically charged droplet source, a charge reduction chamber (hereafter "CR chamber") and a charge reduction reagent ion source that is positioned outside of the CR chamber. The charged droplet source generates charged droplets, optionally in a flow of bath gas, from a liquid sample containing a carrier liquid. At least partial evaporation of carrier liquid from the electrically charged droplets generates analyte ions. The CR chamber is provided in fluid communication with the electrically charged droplet source such that it receives analyte ions, electrically charged droplets or both.

The charge reduction reagent ion source is provided in fluid communication with the CR chamber and positioned outside of the CR chamber. In one embodiment, the charge reduction reagent ion source comprises a means for generating a flow of a precursor gas; and a means for generating positively and/or negatively charged reagent ions from the precursor gas. As used herein, the term "precursor gas" refers to a gas that serves as a precursor for generating reagent ions. Precursor gases of the present invention may also provide a means of transporting reagent ions into the CR chamber. The flow of precursor gas passes through the means for generating reagent ions, thereby generating reagent ions, which are transported from the charge reduction reagent ion source to the CR chamber. Reagent ions react with electrically charged droplets, analyte ions or both in the CR chamber in a manner that affects the charge-state distribution of the analyte ions generated. In an embodiment providing analyte ions having a reduced charge state distribution, for example, at least a portion of the reagent ions provided to the CR chamber have a polarity that is opposite to the polarity of at least a portion of the analyte ions. In this embodiment, reactions between reagent ions and analyte ions, reactions between reagent ions and charged droplets or a combination of these lower the charge states of analyte ions in the CR chamber, thereby resulting in a reduced charge state distribution relative to conventional field desorption ion sources employing electrically charged droplets.

In an embodiment of this aspect of the present invention, an ion source of the present invention is capable of providing analyte ions having a selectively adjustable charge state distribution. In the context of this description, the term "selectively adjustable charge state distribution" refers to the ability of an ion source of the present invention to select the charge state distribution of analyte ions generated over a range of values. Selectively adjustable charge state distribution includes, but is not limited to, a continuously tunable charge state distribution wherein the analyte ion charge state distribution is selectable over a continuous range of values. This feature of the present invention is particularly beneficial for mass spectrometry applications because controlled reduction of analyte ion charge state distribution is useful for reducing the occurrence of analyte ion fragmentation during transportation into and through the mass spectrometer, increasing mass resolution and reducing spectral congestion, thereby allowing for more accurate peak identification, quantification and assignment. The ability to selectively control the extent of charge reduction of analytes generated by ion sources of the present invention is also useful for avoiding signal loss in mass spectrometry applications due to either complete neutralization of analyte ions or due to exceeding the m/z limit of the mass spectrometer.

In one embodiment of this aspect of the present invention, selectively adjustable control of the analyte ion charge state distribution is provided by selectively adjusting the flow rate of precursor gas through the means for generating reagent ions, selectively adjusting the flow rate of reagent ions, precursor gas or both into the charge reduction chamber or a combination of these. Selective adjustment of the flow rates of precursor gas and reagent ions in these embodiments establishes the concentration of reagent ions in the CR chamber, which in turn determines the rate and overall extent of ion-ion and ion-charged droplet reaction processes that lower the charge state of analyte ions in the charge reduction chamber. Optionally, control of analyte ion charge state distribution is also provided in an ion source of the present invention by selectively adjusting the residence time of charged droplets, analyte ions or both in the charge reduction chamber.

In the context of this description, "positioned outside of the CR chamber" refers to a configuration wherein the charge reduction reagent ion source is not housed within the volume of the CR chamber that electrically charged droplets and analyte ions are conducted through. As used herein, however, "positioned outside of the CR chamber" includes configurations wherein the charge reduction reagent ion sources is positioned proximate to, adjacent to and/or in direct physical contact with the CR chamber. Exemplary embodiments, for example, include configurations wherein the charge reduction reagent ion source is directly adjacent to and in physical contact with the CR chamber and configurations wherein one or more elements of the charge reduction reagent ion source provides an interface with the CR chamber.

Use of a charge reduction reagent ion source positioned outside the CR chamber provides a number of benefits in ion sources of the present invention. First, this device configuration provides independent control over conditions and processes involved in analyte ion formation, and conditions and processes used in generating reagent ions. Providing the charge reduction reagent ion source outside the CR chamber, for example, allows the composition of the reagent ions to be selected independently because the composition of precursor gases passed through reagent ion source and/or scavenging gases provided in the charge reduction reagent ion source may be selected independent of the composition of bath gas used for forming and evaporating the electrically charged droplets. Further, this configuration allows the reagent ion sources to be operated under ambient conditions, such as temperature, pressure and flow rates, that are independently selectable regardless of the ambient conditions in the charge reduction chamber. Second, this configuration avoids perturbations in the trajectories of analyte ions and charged droplets in the CR chamber caused by operation of the reagent ion source. In embodiments of the present invention having reagent ion sources that generate electric and/or magnetic fields, for example, positioning the charge reduction reagent ion source outside minimizes generation of undesirable electric and/or magnetic fields in the CR chamber, which can degrade analyte ion transmission efficiency through the chamber. Third, this device configuration provides a high degree of versatility with respect to reagent ion sources useable in ion sources of the present invention because a wide range of reagent ion sources, including discharge (e.g. corona discharge, microwave discharge, RF discharge etc.) sources, plasma sources and optical sources, can be effectively interfaced in a manner so as to provide a flowing source of reagent ions to the CR chamber. Fourth, this device configuration is structurally simple, mechanically robust and allows easy access to the charge reduction reagent ion source during and after operation for tuning and maintenance purposes.

Any means for providing reagent ions capable of providing a flowing source of reagent ions to the CR chamber is useable in the present invention. In one embodiment providing selectively adjustable control of analyte ion charge distributions over a wide range of charge states, the charge reduction reagent ion source comprises a corona discharge that is positioned directly adjacent to and/or in physical contact with the CR chamber. The present invention includes use of a corona discharge comprising a first electrically biased element and a second electrically biased element. First and second electrically biased elements are held at electric potentials that establish a selected potential difference (between these elements) and are separated by a distance close enough to create a self-sustained electrical gas discharge. In one embodiment, the second electrically biased element provides an interface between the reagent ion source and the CR chamber, for example, the second electrically biased element is a plate that separates the CR chamber from the charge reduction reagent ion source. The second electrically biased element may, optionally, have an aperture that allows reagent ions, precursor gas or both to flow through the charge reduction reagent ion source into the CR chamber. Optionally, the aperture may have an area that is selected on the basis of the extent of charge reduction desired, or the aperture may have a selectively adjustable area that can be continuously or discretely changed (or tuned) to provide a desired extent of charge reduction or tunable charge reduction. Exemplary corona discharge configurations useful in the present invention include point-to-plane geometries, such as those provided by an electrically biased wire electrode and an electrically biased disc and/or point-to-plane geometries modified to allow gas flow through the corona discharge, for example by providing an electrically biased element with an aperture or channel (see, description above) for transmitting reagent ions to the CR chamber.

Any means for generating a flow of precursor gas capable of providing a flow of reagent ions into the CR chamber are useable in the present invention. In a useful embodiment, the means for generating a flow precursor gas serves the additional function of providing a bath gas (i.e. carrier gas) for transporting reagent ions into the CR chamber. Means for generating a flow of precursor gas providing a selectively adjustable flow rate are particularly useful in ion sources of the present invention providing analyte ions having a selective adjustable charge state distribution because selection of the flow rate of precursor gas provides an effective means of controlling the concentration of reagent ions in the CR chamber, and, thus, controlling the rate and extent of charge reduction achieved. The flow rate of precursor gas (and also bath gases and scavenging gases) may be selectively adjusted in the present invention by any means known in the art, including use of metering valves, shut off valves, gas flow controllers, gas flow meters, changing the backing pressure of a pressurize source (e.g. gas cylinder or liquid having an appreciable vapor pressure) and/or selectively changing the vapor pressure of a liquid (for example, by changing the temperature of the liquid).

In another aspect, the present invention provides ion sources wherein analyte ions formed are less susceptible to undergoing chemical modifications, such as oxidation and adduct reactions that result in an appreciable shift in their mass (e.g. mass increase greater than 5 amu). In one embodiment of this aspect of the present invention, an ion source of the present invention further comprises a means for generating a flow of one or more scavenging gases that passes through the means for generating reagent ions. Scavenging gases react with chemical species (reactive neutrals, ions or both) that are capable of oxidizing and/or undergoing adduct reactions with analyte ions in the CR chamber, and, thus, are useful for minimizing the extent of unwanted chemical processes that shift the masses of analyte ions generated. Preferably for some applications, reactions involving scavenging gases render these chemical species unable to participate in oxidation and/or adduct formation reactions with analyte ions in the CR chamber. Useful scavenging gases are highly reactive with oxygen atoms ($O(^1D)$ and $O(^3P)$), hydroxyl radical, peroxy radicals, and nitrogen oxides ($NO$, $NO_2$, $NO_3$, $N_2O_5$ etc.)), and include, but are not limited to, organic vapors such as alcohols (e.g. methanol, ethanol, propanol), nitrites, ketones, aldehydes, esters, carboxylic acids, alkanes, and alkenes. Useful means for generating a flow of one or more scavenging gases include, but are not limited to, bubbling a bath gas though an appropriate solvent and/or introducing the scavenging gas to the charge reduction reagent ion source directly as a vapor. Means for generating a flow of one or more scavenging gases preferred for some applications are capable of providing a selected flow rate and/or partial pressure of scavenging gas in the charge reduction reagent ion source. Ion sources of this aspect of the present invention are particularly well suited for mass spectrometry applications because minimizing the extent of adduct formation and oxidation reactions involving analyte ions decreases overall spectral congestion and enhances the intensities of peaks attributable to analyte ions that undergo little change in mass, thereby allowing for easier interpretation of mass spectra obtained.

In another aspect, the present invention provides a device for determining the identity or concentration of chemical species in a liquid sample. In one embodiment, a charged particle analyzer is provided in fluid communication with the CR chamber of an ion source of the present invention. The charged particle analyzer and CR are configured such that at least a portion of the analyte ions having a selected charge state distribution are transported to the analyzer for measurement and characterization. Useful charged particle analyzers for receiving and analyzing analyte ions include mass spectrometers for characterizing gas phase analytes on the basis of their mass and electrical charge, such as a time of flight mass spectrometer, an ion trap mass spectrometer, a quadrupole mass spectrometer, a tandem mass spectrometer; and a residual gas analyzer. The present invention also includes devices having charge particle analyzers that characterize analyte ions on the basis of other properties, for example characterization on the basis of electrophoretic mobility using a differential mobility analyzer or ion mobility spectrometer.

Any means of interfacing the CR chamber and the charge particle analyzer may be used in the invention providing efficient transmission of analyte ions from the CR chamber to the analyzer. In embodiments having a charged particle analyzer comprising a mass spectrometer, for example, the CR chamber may be directly attached to the nozzle of the mass spectrometer, for example using an o-ring seal connecting the outlet end of the CR to the front of the mass spectrometer. Direct coupling of the CR and the mass spectrometer via an o-ring seal results in a vacuum induced flow of analyte ions into the nozzle, which eliminates the need for a bath gas or carrier gas. Such a directly coupled CR chamber may be regarded as a nozzle extension and has a benefit of providing effective transport of analyte ions into the mass spectrometer without differential pumping the nozzle extension. Furthermore, use of CR chambers having a relatively small internal volume (e.g. less than 10 $cm^3$) is useful for providing effective transport of analyte ions into the mass spectrometer via pumping through the inlet of the mass spectrometer and, therefore, does not require large bath gas flows.

Use of ion sources of the present invention as a source of analyte ions for mass spectrometry analysis has several important benefits. First, control of analyte charge state distribution provided by the present invention provides a means of reducing the charge states of analyte ions entering the mass spectrometer in a manner leading to good sensitivity. For example, charge reduction provided by the present ion sources decreases the occurrence of analyte ion fragmentation upon interacting with the nozzle and skimmer of the mass spectrometer (i.e. reducing in-source fragmentation), thereby increasing transmission efficiency and sensitivity. Further, ion sources of the present invention are capable of providing charge reduction in a manner that does not significantly perturb the trajectory of ions through the CR chamber and into the mass spectrometer, which minimizes analyte ion losses, thereby increasing transmission efficiency and sensitivity. Second, the ability of ion sources of the present invention to reduce the charge state distribution of analyte ions provides a means of decreasing the net number of peaks associated with a given analyte and also provides a means of spreading these peaks over a wider m/z range. This attribute of the present invention is beneficial as it reduces spectral congestion, thereby allowing for easier peak identification, quantification and assignment. Finally, ion sources of the present invention are highly versatile and, thus, can be used with virtually any type of mass spectrometer and virtually any type of charged particle source. Ion sources of ion sources of the present invention provide a continuous or pulse source of analyte ions, and provide analyte ions having a constant, selected charge state distribution or analyte ions having a charge state distribution that selectively varies as a function of time.

In another aspect the present invention provides a method of generating analyte ions having a selected charge state distribution from a liquid sample containing a carrier liquid comprising the steps of: (1) producing a plurality of electrically charged droplets of the liquid sample; (2) at least partially evaporating carrier liquid from said electrically charged droplets, thereby generating analyte ions; (3) passing the electrically charged droplets, analyte ions or both through a charge reduction chamber; (4) exposing the droplets, analyte ions or both to reagent ions generated from a charge reduction reagent ion source in fluid communication with said charge reduction chamber and positioned outside of said charge reduction chamber, said charge reduction reagent ion source comprising; a means for generating a flow of a precursor gas; and a means for generating reagent ions from said precursor gas; wherein said flow of precursor gas passes through said means for generating reagent ions, thereby generating reagent ions which are transported into said charge reduction chamber and react with electrically charged droplets, analyte ions or both in the charge reduction chamber to change the charge-state distribution of the analyte ions, thereby generating said analyte ions having a selected charge state distribution.

In another aspect, the present invention provides a method for determining the identity or concentration of chemical species in a liquid sample containing the chemical species in a carrier liquid comprising the steps of: (1) producing a plurality of electrically charged droplets of the liquid sample, (2) at least partially evaporating carrier liquid from said electrically charged droplets, thereby generating analyte ions; (3) passing the droplets, analyte ions or both through a charge reduction chamber; (4) exposing the droplets, analyte ions or both to reagent ions generated from a charge reduction reagent ion source in fluid communication with said charge reduction chamber and positioned outside of said charge reduction chamber, said charge reduction reagent ion source comprising a means for generating a flow of a precursor gas; and a means for generating reagent ions from said precursor gas; wherein said flow of precursor gas passes through said means for generating reagent ions, thereby generating reagent ions which are transported into said charge reduction chamber and react with electrically charged droplets, analyte ions or both in the charge reduction chamber to change the charge-state distribution of the analyte ions, (5) controlling the charge-state distribution of said analyte ions by selectively adjusting the flow rate of precursor gas through the means for generating reagent ions, the flow rate of reagent ions, precursor gas or both into the charge reduction chamber or both; and (6) analyzing said analyte ions with a charged particle analyzer, thereby determining the identity or concentration of said chemical species.

In another aspect, the present invention provides a method of reducing fragmentation of ions generated from electrospray discharge of a liquid sample containing chemical species in a carrier liquid, comprising the steps of: (1) producing a plurality of electrically charged droplets of the liquid sample; (2) at least partially evaporating carrier liquid from said electrically charged droplets, thereby generating analyte ions; (3) passing the electrically charged droplets, analyte ions or both through a charge reduction chamber; (4) exposing the droplets, analyte ions or both to reagent ions generated from a charge reduction reagent ion source in fluid communication with said charge reductizon chamber and positioned outside of said charge reduction chamber, said charge reduction reagent ion source comprising a means for generating a flow of a precursor gas; and a means for generating reagent ions from said precursor gas; wherein said flow of precursor gas passes through said means for generating reagent ions, thereby generating reagent ions which are transported into said charge reduction chamber and react with electrically charged droplets, analyte ions or both in the charge reduction chamber to change the charge-state distribution of the analyte ions; and (5) reducing the charge-state distribution of said analyte ions by selectively adjusting the flow rate of precursor gas through the means for generating reagent ions, the flow rate of reagent ions, precursor gas or both into the charge reduction chamber or both, thereby reducing fragmentation of said ions.

DETAILED DESCRIPTION

Figure 1:
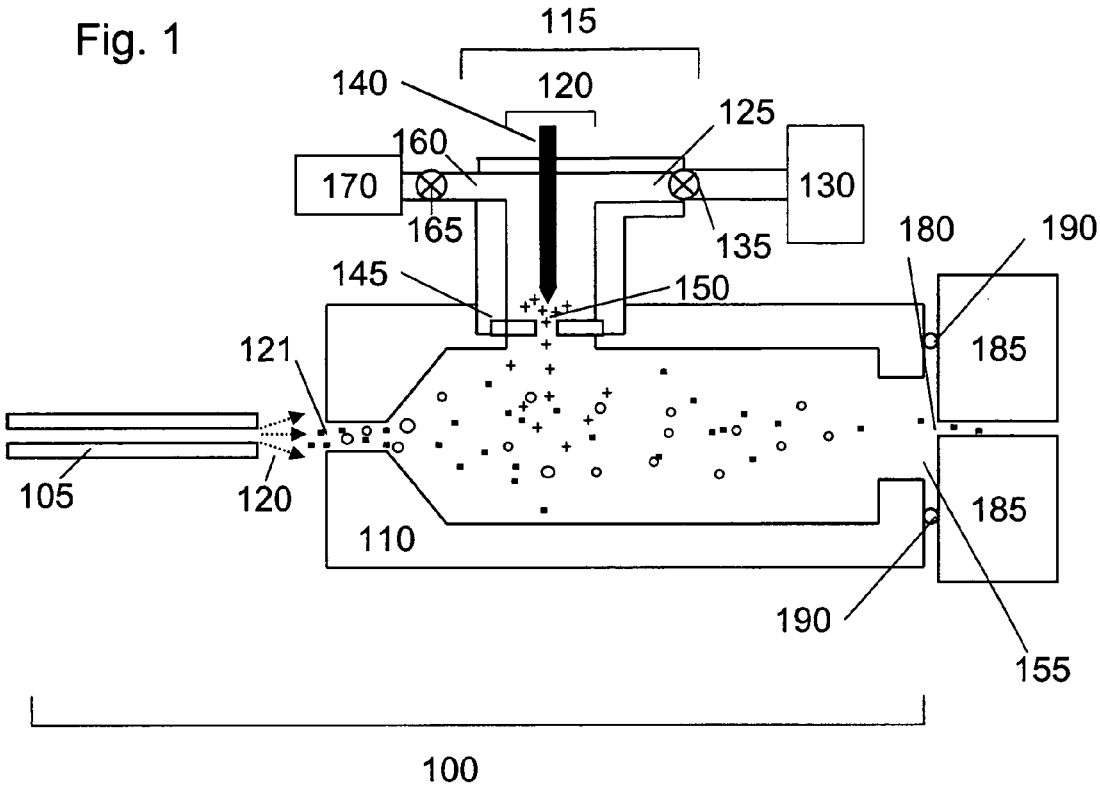
FIG. 1 provides a schematic diagram showing a cross sectional view of an ion source of the present invention for generating analyte ions having a selected charge state distribution.

Referring to the drawings, like numerals indicate like elements and the same number appearing in more than one drawing refers to the same element. In addition, hereinafter, the following definitions apply:

"Molecule" refers to a collection of chemically bound atoms with a characteristic composition. As used herein, a molecule can be neutral or can be electrically charged, such as singly charged and multiply charged molecules. The term molecule includes biomolecules, which are molecules that are produced by an organism or are important to a living organism, including, but not limited to, proteins, peptides, lipids, DNA molecules, RNA molecules, oligonucleotides, carbohydrates, polysaccharides; glycoproteins, lipoproteins, sugars and derivatives, variants and complexes of these.

"Ion" refers generally to multiply or singly charged atoms, molecules, macromolecules having either positive or negative electric charge and to complexes, aggregates and clusters of atoms, molecules and macromolecules having either positive or negative electric charge.

"Reagent ions" refer to gas phase ions of positive polarity, negative polarity, or both positive and negative polarity that are generated by a charge reduction reagent ion source. Optionally, reagent ions may also refer to free electrons in the gas phase generated by a means for generating reagent ions. Reagent ions react with analyte ions, electrically charged droplet or both to change the charge state distribution of analyte ions. Reagent ions of the present invention may be singly charged, multiply charged, or both, and may comprise one or more atoms or molecules or aggregates, complexes and clusters thereof. For example, $H^+$, $N_2^+$, $N_4^+$, $H_2O^+$, $NH_4^+$, $H_3O^+$ and $CH_3OH_2^+$ are positively charged reagent ions and $O^-$, $O^{2-}$, $N^{2-}$, $CN^-$, $NO_2^-$, $NO_3^-$, $CO_3^-$, $OCN^-$, $HCO_2^-$, $CH_3CO_2^-$, $CF_3CO_2^-$, $CH_3O^-$, and $C_2H_5O^-$ are negatively charged reagent ions useful in the present invention. A bipolar reagent ion gas specifically refers to a collection of reagent ions that includes both positively and negatively charged reagent ions in the gas phase.

"Analyte ions" refer to multiply charged ions, singly charged ions, or both, generated from chemical species in liquid samples. Analyte ions of the present invention may be of positive polarity, negative polarity or both. Analyte ions may be formed directly upon at least partial evaporation of solvent and/or carrier liquid from charged droplets or upon at least partial evaporation of solvent and/or carrier liquid from charged droplets followed by subsequent reaction with reagent ions. Analyte ions are characterized in terms of their charge-state distribution which is selectively adjustable in the present invention.

"Solvent" and "carrier liquid" are used synonymously and refer to compounds present in liquid samples that dissolve chemical species and/or aid in the dispersion of chemical species into droplets. Typically, solvent and/or carrier liquid are present in liquid samples in greatest abundance.

"Liquid sample" refers to a homogeneous mixture or heterogeneous mixture of at least one chemical species and at least one solvent and/or carrier liquid. Commonly, liquid samples comprise liquid solutions in which chemical species are dissolved in at least one solvent.

"Bath gas" and "carrier gas" are used synonymously and refer to a collection of gas molecules that aid in the formation and/or transport of charged droplets, analyte ions and/or reagent ions. Common bath gases include, but are not limited to: nitrogen, oxygen, argon, air, helium, water, sulfur hexafluoride, nitrogen trifluoride, carbon dioxide and water vapor.

"Charged particle analyzer" refers to a device or technique for determining the identity, properties (e.g. mass, charge, composition, structure, electrophoretic mobility etc.) and/or abundance (number or concentration of charged particles, such as analyte ions). Examples of charged particle analyzers include, but are not limited to, mass analyzers, mass spectrometers and devices capable of measuring electrophoretic mobility such as a differential mobility analyzer.

A "mass analyzer" is used to determine the, mass, charge, mass-to-charge ratio and/or mobility (e.g. electrophoretic) of gas phase ions. Mass analyzers are capable of analyzing positive ions, negative ions, or both. Examples include, but are not limited to, a time of flight mass spectrometer, a quadrupole mass spectrometer, a residual gas analyzer, a tandem mass spectrometer, an ion trap a Fourier transform ion cyclotron resonance spectrometer, a differential mobility analyzer and an ion mobility spectrometer.

"Residence time" refers to the time a flowing material spends within a given volume. Specifically, residence time may be used to characterize the time analyte ions, charged droplets and/or bath gas take to pass through a charge reduction chamber. Residence time is related to linear flow rate and path length by the following expression: Residence time=(path length)/(linear flow rate). Under some conditions, residence time is approximately equal to the reaction time between analyte ions and reagent ions in a charge reduction chamber.

"Charge-state distribution" refers to a two dimensional representation of the number of ions of a given composition populating each ionic state present in a sample of ions. Accordingly, charge-state distribution is a function of two variables; number of ions and ionic state (i.e. electric charge). Summation over all ionic states of the charge state distribution yields the total number of ions of a given composition in a sample. Charge state distribution is a property of a selected composition of an ion. Accordingly it reflects the ionic states populated for a specific composition, as opposed to reflecting the ionic states of all ions present in a sample. A reduced charge state distribution refers to a charge state distribution that is shifted to lower charge states relative to the charge state distribution of analyte ions generated via conventional field desorption methods employing charged droplets.

"Fluid communication" refers to the configuration of two or more elements such that a fluid (e.g. a gas, a vapor or a liquid) is capable of flowing from one element to another element. Elements may be in fluid communication via one or more additional elements such as tubes, channels, valves, pumps or any combinations of these.

"Positive mode" refers to operation of a corona discharge comprising a first electrically biased element provided at a positive voltage with respect to a second element, wherein the first electrically biased element and the second element are separated by a distance close enough to create a self-sustained electrical gas discharge.

"Negative mode" refers to operation of a corona discharge comprising a first electrically biased element provided at a negative voltage with respect to a second element, wherein the first electrically biased element and the second element are separated by a distance close enough to create a self-sustained electrical gas discharge.

"Charge reduction chamber" refers to a device component useful in methods and devices of the present invention wherein analyte ions undergo charge reduction by interacting with reagent ions of opposite polarity present in the charge reduction chamber. In the present invention, charge reduction may also occur in the charge reduction chamber by processes involving interactions between electrically charged droplets and reagent ions of opposite polarity. Other processes useful for analyte ion production and control of charge state distribution may also occur in the charge reduction chamber including, but not limited to, field desorption of ions from electrically charged particles, evaporation or desolvation of electrically charged particles, desolvation and/or controlled fragmentation of analyte ions, recharging of analyte ions and combinations of these processes.

This invention provides methods, devices and device components for preparing ions from liquid samples containing chemical species and methods and devices for analyzing chemical species in liquid samples. The present invention provides an ion source for generating analyte ions having a selected charge state distribution, such as a reduced charged state distribution, that may be effectively interfaced with a variety of charged particle analyzer, including virtually any type of mass spectrometer.

FIG. 1 provides a schematic diagram showing a cross sectional view of an ion source of the present invention for generating analyte ions having a selected charge state distribution. As shown in FIG. 1, ion source 100 comprises source of charged droplets 105 (such as an electrospray source of charged droplets) CR chamber 110 and charge reduction ion source 115 positioned outside of CR chamber 110. Source of charged droplets 105 generates electrically charged droplets, optionally in a flow of bath gas, (schematically illustrated as dotted arrows 120) from a liquid sample containing a carrier liquid. Electrically charged droplets undergo at least partial evaporation of the carrier liquid and generate analyte ions. CR chamber 110 is positioned in fluid communication with source of charged droplets 105 and is capable of receiving at least a portion of the electrically charged droplets, analyte ions or both generated by source of charged droplets 105. In a useful embodiment, wherein the source of charged droplets is an electrospray source, a positive or negative potential difference is maintained between the electrospray and the CR chamber to facilitate formation of charged droplets.

The present invention includes embodiments wherein the electrospray is provided at a large positive electric potential (e.g. about 1,000 V-about 10,000 V) or a large negative electric potential (e.g. about −1,000 V-about-10,000 V) and the CR chamber is provided substantially close to ground (e.g. about 1000 V to −1000 V). In these embodiments, the corona discharge needle is held at an electric potential about 2000 to 5000 V different from the CR chamber to provide an effective corona discharge. Alternatively, the present invention includes embodiments wherein the electrospray is provided at an electric potential substantially close to ground (e.g. about 1000 V to −1000 V) and the CR chamber is provided at a large positive electric potential (e.g. about 1,000 V-about 10,000 V) or a large negative electric potential (e.g. about −1,000 V-about-10,000 V). In this embodiment, the corona discharge needle is held at an electric potential 2000 to 5000 V different from the CR chamber to provide an effective corona discharge. In one embodiment, for example, electrospray from a grounded ESI spray tip to a −10,000V inlet/chamber requires −15,000V on the corona discharge needle.

Analyte ions entering CR chamber 110 via inlet 121 can undergo charge reduction. Optionally, electrically charged droplets also enter the CR chamber 110 via inlet 121, and undergo field desorption thereby generating analyte ions in the CR chamber 110. In FIG. 1, this process is schematically represented by illustrating charged droplets as open circles and analyte ions as closed circles (note that the open and closed circles are not to scale). Evaporation of electrically charged droplet may be optionally promoted by use of a dry bath gas and/or, by heating CR chamber 110. Passage of analyte ions (and optionally charged droplets) through CR chamber 110 is provided by pumping on the outlet 155 of CR chamber 110. Optionally, passage of charged droplet and analyte ions through the CR chamber may be achieved by providing a flow of bath gas through the CR chamber 110.

Charge reduction reagent ion source 115 is positioned in fluid communication with, and outside of, CR chamber 110. As shown in FIG. 1, charge reduction reagent ion source 115 comprises a corona discharge 120 and an inlet 125 for introducing a flow of precursor gas, scavenging gas or both. In the embodiment shown in FIG. 1 inlet 125 is coupled to a source of precursor gas 130 (e.g. a gas cylinder or liquid reservoir) via metering valve 135 so that the flow rate of precursor gas through charge reduction reagent ion source 115 can be selectively adjusted, such as embodiments wherein the flow of precursor gas can be selectively adjusted over the range of about 0.01 standard cubic centimeters per second to about 100 standard cubic centimeters per second. Corona discharge 120 comprises wire electrode 140 provided at a first electric potential and metal disc 145 provided at a second electric potential wherein first and second electric potentials generate a selected potential difference (between wire electrode 140 and metal disc 145). Optionally, metal disc may be in electrical contact with and/or held at the same electric potential as CR chamber 110. To provide electrical biasing wire electrode 140 and/or metal disc 145 are connected to appropriate voltage sources (not shown in FIG. 1). Wire electrode 140 and metal disc 145 have a selected potential difference (e.g. about 1000 to 5000 V) and are separate by a distance close enough to create a self-sustained electrical gas discharge thereby generating reagent ions (schematically illustrated in FIG. 1 as + symbols) from the precursor gas provided in charge reduction reagent ion source 115 through inlet 125.

The corona discharge 120 depicted in FIG. 1 is operational in several different modes. Operation of the corona discharge in positive and negative modes results in ejection of electrons from precursor gas molecules thereby producing free electrons and positively charged ions. Ejected free electrons interact with other precursor gas molecules to generate negatively charged and/or positively charged reagent ions. Operation of the corona in negative mode, however, principally provides a source of negative ions to the CR chamber 110, as most positive ions generated follow the intense electric field lines toward the negatively charged wire cathode and are annihilated. Similarly, operation of the corona in positive mode provides a source of positive ions to the CR chamber 110, as most negative ions generated follow the intense electric field lines toward the positively charged wire anode and are annihilated. The present invention includes use of reagent ion sources that are capable of providing a source of both positive and negative reagent ions (i.e. a bipolar gas) to the CR chamber 110, for example as provided by a radioactive source of reagent ions which simultaneously provides positive and negative ions to the CR chamber 110 or a RF corona discharge which alternates between providing positive and negative ions to the CR chamber 110.

As depicted in FIG. 1, metal disc 145 is positioned in physical contact with CR chamber 110 such that it provides the interface between charge reduction reagent ion source 115 and CR chamber 110 and, is optionally held at the same electric potential as the CR chamber 110. In addition, metal disc 145 has an aperture 150 that allows reagent ions to be transported into CR chamber 110 via a combination of diffusion and active transport processes provided by the flow of precursor gas. Aperture 150 has an area selected to provide a selected concentration of reagent ions in the CR chamber 110 and a selected extent of charge reduction. In one embodiment, aperture 150 has an area selected from the range of about 0.1 $mm^2$ to about 10 $mm^2$. Optionally, aperture 150 has a selectively adjustable area to provide tunable charge reduction. Wire electrode 140 and metal disc 145 are, therefore, configured in a modified point-to-plane geometry, due to the presence of aperture 150. Corona discharge 120 may be operated in either positive ion or negative ion mode, and may provide a source of positively charged reagent ions and/or negatively charged reagent ions to the CR chamber 110.

Reagent ions pass through aperture 150 into CR chamber 110. Within the volume of the charge reduction chamber 110, analyte ions and/or electrically charged droplets interact with reagent ions of opposite polarity, thereby undergoing charge reduction. Upon desorption from the charged droplets, analyte ions typically possess a charge state distribution centered around a highly multiply charged state. The charge-state distribution of analyte ions is reduced, however, upon interaction with oppositely charged reagent ions in the charge reduction chamber 110. Specifically, ion-ion chemical reactions in the charge reduction chamber between analyte ions and oppositely charged reagent ions result in a shift in the charge state distribution of the analyte ions from highly charged states to lower charged states. Charge reduction may also be achieved in the present invention via interactions between electrically charged droplets and oppositely charged reagent ions. In a preferred embodiment, the extent of charge reduction that analyte ions undergo is selectively adjustable. Accordingly, multiply charged analyte ions lose electric charge upon passing through charge reduction chamber 110, ultimately reach a selected charge state distribution and exit charge reduction chamber 110 by passing through outlet 155.

Several factors govern the charge-state distribution of the analyte ions exiting the ion source of the present invention and, hence, influence the extent of charge reduction achieved. The concentration of reagent ions in the CR chamber 110, at least in part, determines the rate and extent of charge reduction of analyte ions generated by ion source 100. Selective adjustment of the flow rate of precursor gas through charge reduction reagent ion source 115 provides a means for controlling the concentration of reagent ions in the CR chamber and, therefore, provides a means for selecting the extent of charge reduction and the charge state distribution of analyte ions exiting the ion source. In addition, the charge state distribution of analyte ions exiting the ion source may also be selectively adjusted by variation of the residence time of analyte ions in the CR chamber 110. The charge state distribution of analyte ions exiting the ion source may also be selectively adjusted by variation of the physical dimensions (e.g. area, diameter etc.) of the aperture in the second electrically biased element of the corona discharge. In these embodiments, the size of the aperture at least in part determines the concentration of reagent ions in the CR Chamber. Furthermore, the charge-state distribution of the analyte ions exiting the ion source may be selectively adjusted under some conditions by selection of the potential difference between first and second electrically biased elements of the corona discharge, which governs the rate at which electrons and/or reagent ions are generated for a given gap spacing, and consequently determines, in part, the concentration of reagent ions in the charge reduction reagent ion source 115.

Optionally, charge reduction reagent ion source 115 may further comprise one or more additional inlets 160, additional metering vales 165 and additional sources of other precursor gases and scavenging gases 170. In the present invention, scavenging gas may be added to the charge reduction reagent ion source 115 for the purpose of reacting with unwanted chemically reactive species generated by the corona discharge that are capable of undergoing adduct and/or oxidation reactions with analyte ions. Reaction with scavenger gases preferably transforms such unwanted chemically reactive species into a form (i.e. a new composition) that does not react appreciably with the gas phase analyte ions. Therefore, addition of scavenging gas to the charge reduction reagent ion source 115 provides a means of rendering such unwanted reactive species in a state wherein they do not react with reagent ions in the CR chamber 110. Therefore, the present invention provides charge reduction reagent ion sources having an output wherein the abundance of unwanted chemical reactive species that undergo adduct and/or oxidation reactions with analyte ions are minimized. Source of scavenging gases 170 useful in the present invention include devices that bubble carrier gas through a liquid and devices that introduce the scavenging gas directly as a vapor.

Referring again to FIG. 1, ion source 100 may be directly interfaced with the inlet 180 of a mass spectrometer 185 to provide a device for identifying and/or measuring the concentrations of analytes in a liquid sample. In this embodiment, analyte ions exiting ion source 100 are drawn into the mass spectrometer 185. Upon entering mass spectrometer 185, analyte ions are detected and classified on the basis of mass and electric charge. Direct interfacing of the ion source and mass spectrometer may be provide by an o-ring connection 190, wherein the CR chamber 110 is provided to the mass spectrometer as a nozzle extension. In this embodiment, pumping of the CR chamber 110 through the inlet 180 provides a means of conducting analyte ions through the CR chamber 110 and into the mass spectrometer 185. Use of CR chambers having a volume less than or equal to 10 $cm^3$ is useful for eliminating the need for a flow of bath gas to conduct analyte ions and charged droplets through the CR chamber 110, as transport of analyte ion may be effectively carried out via pumping through the mass spectrometer. The volume of the CR chamber must be large enough in the present invention to provide residence times of analyte ions in the CR chamber large enough to achieve a desired extent of charge reduction.

It should be recognized by anyone of ordinary skill in the art of ion sources that the corona discharge configurations described are but one means employable for the generation of positively or negatively charged reagent ions from precursor gas molecules. Accordingly, it is to be understood that any other means of generating reagent ions may be substituted for the corona discharge sources described in the present invention. Alternative reagent ion sources include, but are not limited to, plasma ion sources, thermionic electron guns, microwave discharges, inductively coupled plasma sources, lasers, radioactive sources and other sources of electromagnetic radiation and radioactive ion sources.

It should be recognized that the method of ion production, classification and detection employed in the present invention is not limited to analysis via mass spectrometry and is readily adaptable to virtually any mass analyzer. Applicable mass analyzers include, but are not limited to, time-of-flight mass spectrometers (linear and orthogonal), quadrupole mass spectrometers, tandem mass spectrometers, ion traps, Fourier transform ion cyclotron resonance and magnetic sector mass analyzers. For some applications, an orthogonal TOF analyzer is preferred because it is capable of measurement of m/z ratios over a very wide range that includes detection of singly charged ions up to approximately 30,000 Daltons. It should also be recognized that the ion production method of the present invention may be utilized in sample identification and quantitative analysis applications employing charged particle analyzers other than mass analyzers. Ion sources of the present invention may be used to prepare ions for analysis by electrophoretic mobility analyzers. In an exemplary embodiment, a differential mobility analyzer is operationally coupled to the charge reduction chamber to provide analyte ion classification by electrophoretic mobility. In particular, such applications are beneficial because they allow ions of the same mass to be distinguished on the basis of their electrophoretic mobility.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. Methods and devices useful for the present methods can include a large number of optional device elements and components including, ion optics such as ions lenses, optics for manipulating electromagnetic radiation such as lenses, reflectors and windows, microfluidic and nanofluidic elements such as channels and chambers, flow through reactors, vacuum chambers, temperature sensors and controllers, valves, pumps, separation systems including chromatographic systems (i.e. gas phase and liquid phase chromatography systems) and capillary electrophoresis systems, mass analyzers, and mobility analyzers.

All references cited in this application are hereby incorporated in their entireties by reference herein to the extent that they are not inconsistent with the disclosure in this application. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques specifically described herein are intended to be encompassed by this invention.

When a group of materials, compositions, components or compounds is disclosed herein, it is understood that all individual members of those groups and all subgroups thereof are disclosed separately. When a Markush group or other grouping is used herein, all individual members of the group and all combinations and subcombinations possible of the group are intended to be individually included in the disclosure. Every formulation or combination of components described or exemplified herein can be used to practice the invention, unless otherwise stated. Whenever a range is given in the specification, for example, a temperature range, a time range, or a composition range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms.

EXAMPLE 1

Charge Reduction Electrospray Mass Spectrometry Using an Orthogonal Acceleration Time of Flight Mass Spectrometer The ability of ion sources of the present invention to provide a source of analyte ions having a reduced charge state distribution for sensitive mass spectrometry detection and characterization was verified by experimental studies. Specifically, sensitivities and mass resolution obtained for high molecular weight biomolecules using the present charge reduction electrospray mass spectrometry (CREMS) techniques were quantified and compared to sensitivities and mass resolution provided by conventional electrospray mass spectrometry methods. Either a corona discharge or an α-particle source was employed to generate anions that abstract protons from electrosprayed protein cations. These desired ion/ion proton transfer reactions predominated, but some oxidation and ion-attachment reactions also occurred leading to new peaks or mass-shifted broader peaks while decreasing signal intensity. The species producing these deleterious side-reactions were identified, and conditions were found that prevented their formation. Spectrometer m/z biases were examined because of their effect upon the signal intensity of higher m/z charge-reduced protein ions. The utility of this atmospheric pressure CREMS was demonstrated using a cell lysate fraction from *E. coli*. The spectral simplification afforded by CREMS reveals more proteins than are observed without charge reduction.

A. Introduction

Mass spectrometric analysis of intact proteins has been practiced routinely since the advent of two soft ionization techniques for large molecules: matrix assisted laser desorption ionization (MALDI) and electrospray ionization (ESI). Each of these techniques has advantages for different situations and often they are complementary in terms of which proteins ionize well. A primary difference between the two techniques is that MALDI generates ions in one or two low charge states, whereas ESI tends to create protein ions in a number of different and relatively high charge states. In fact, electrospray tends to put most proteins into the same m/z range of the spectrum (ca. 500-2500). While advantageous in some circumstances, this phenomenon can limit the ability to analyze protein mixtures by ESI due to spectral congestion. Such mixtures might comprise several truly distinct proteins or may involve heterogeneity of a "single" protein due to combinations of splice variants and post-translational modifications. In the latter case, this microheterogeneity means the sample contains many similar species with slightly different molecular weights, which lead to broader peaks for each charge state and consequently increased probability of peak overlap.

One way to avoid overlapping peaks from mixtures is with very high resolving power, and Fourier transform spectrometers have provided very good results in this regard. Another method is to decrease the number of charge states for each analyte and to spread out these charge state peaks on the m/z scale, both of which can be accomplished by reducing the charge, z, of the protein ions. Ideally, this charge reduction technique would be amenable to any type of mass analyzer, subject only to mass range limitations, and would maintain or enhance ESI's gentle ionization as well as its suitability for online analysis after separation.

Charge reduction of electrosprayed ions has been performed using a few different strategies. ESI of proteins typically employs positive-ion mode whereby the proteins acquire charge by protonation of their basic residues. Thus, the most straightforward route to charge reduction would be a proton transfer reaction (PTR). Several researchers used strong neutral bases and succeeded in removing a few protons from the protein ions. In contrast to these ion/molecule reactions, McLuckey and co-workers have utilized ion/ion reactions to achieve extensive and controllable charge reduction. [McLuckey, S. A.; Stephenson, J. L., Jr. Ion/ion chemistry of high-mass multiply charged ions. Mass Spectrom. Rev. 1998, 17, 369-407.; He, M.; McLuckey, S. A. Charge permutation reactions in tandem mass spectrometry. J. Mass Spectrom. 2004, 39, 1231-1259; & Stephenson, J. L., Jr.; McLuckey, S. A. Ion/Ion Reactions in the Gas Phase: Proton Transfer Reactions Involving Multiply-Charged Proteins. J. Am. Chem. Soc. 1996, 118, 7390-7397.] Their method involves modification of a quadrupole ion trap instrument in order to inject and hold gas-phase anions simultaneously in the trap with the protein cations.

In this example, we explore the issues of protein oxidation, adduct formation, and possible ion losses occurring during CREMS in order to reach an understanding that has led to enhanced control over the charge reduction technique. An optimized design is presented for a small charge reduction device that is easily fabricated and attached to the inlet of nearly any ESI-compatible mass spectrometer. With slight modification the device allows for either a corona discharge or alpha-particle source to generate the gas-phase anions, and we compare and contrast these two types of sources. The extent of charge reduction is easily tuned, which helps to separate overlapping peaks while working within the m/z constraints of the mass analyzer. Furthermore, we have developed an understanding of oxidation and adduction reactions that can occur during charge reduction. This understanding allowed us to find conditions that avoid these types of deleterious side-reactions. The CREMS technique is shown here to be suitable for analysis of mixtures of large intact proteins, as is demonstrated for an unknown protein mixture derived from a cell lysate.

B. Experimental

B.1. Chemicals and Samples

Insulin (bovine) and bradykinin were obtained from Sigma Chemical Co. and used without further purification. Samples were dissolved in a buffer of 1:1H2O:MeOH containing 1% acetic acid to a concentration of 3 or 10 μM. Platinum wire (99.95%, 0.368 mm dia.) was purchased from Alfa Aesar. Burdick & Jackson HPLC-grade water, methanol, and acetonitrile were used as solvents and as sources of the corresponding vapors. Compressed nitrogen and USP-grade medical air were obtained from Linde. A protein sample fraction from an ion-exchange and reverse-phase separation of an *E. coli* cell lysate was used as received from collaborators, Dave Robinette and Morgan Giddings, at the University of North Carolina—Chapel Hill. This sample was electrosprayed from a 1:1H2O:ACN buffer containing 0.1% formic acid.

B.2. CREMS Source Construction

Figure 2A:
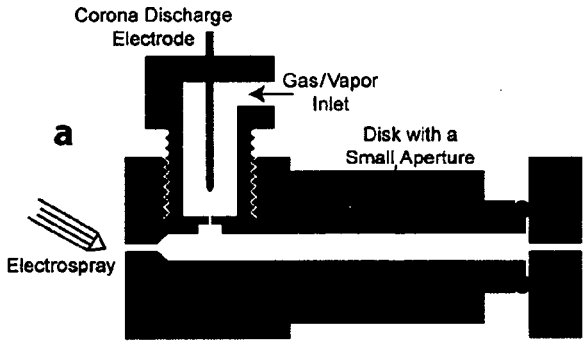
FIGS. 2A and 2B provide schematic diagrams illustrating side views of ion sources providing charge reduction having a corona discharge reagent ion source (2A) and a radioactive reagent ion source (2B).
Figure 2B:
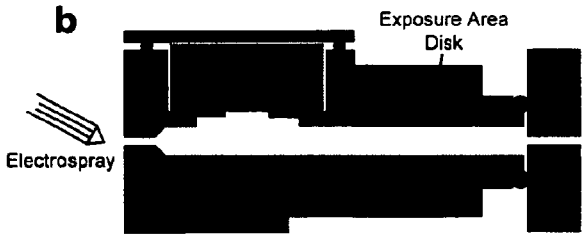

FIGS. 2A and 2B provide schematic diagrams illustrating sides views of ion sources providing charge reduction having a corona discharge reagent ion source (2A) and a radioactive reagent ion source (2B). The CREMS sources shown in FIGS. 2A and 2B are small devices (~4.5 cm long) that mount directly to the mass spectrometer inlet, and therefore are referred to as nozzle extensions. Prior work with charge reduction employed a rather large chamber sitting in front of the nozzle, and it required high flow rates of bath gas to transport ions through the chamber. In contrast, the new design has an o-ring seal that leads to a vacuum-induced air-flow, which obviates the need for bath gas. For the corona discharge device (FIG. 2*a*), another improvement was removing the corona discharge from the path of the electrospray ions. These changes in design improved transmission of the electrospray ions by nearly an order of magnitude.

The charge reduction chambers were machined from stainless steel (blue components in FIGS. 2A and 2B). The entrance hole for electrospray ions was 0.9 mm diameter for the first 3 mm, and 2.5 mm dia. for the remaining 42 mm of the chamber. These dimensions should cause minimal pressure drop through the chamber because the majority of the pressure decrease will occur at the smaller nozzle orifice of the mass spectrometer (0.35 mm dia.×20 mm long). This orifice defines the gas flow rate (G) through the charge reduction chamber according to the equation: $G=0.445\ naD^2$, where n and a are the number density and speed of sound for nitrogen gas (2.5×1019 molecules/cm3 and 3.5×104 cm/s, respectively), and D is the orifice diameter. The resulting 4.8×1020 molecules/s, or 19 cm3/s, yields a linear flow velocity of 390 cm/s, which corresponds to a residence time of 10 ms in the charge reduction chamber. The important result from these calculations is this 10 ms reaction time between electrospray ions and corona discharge generated ions.

Although functionally accurate, the red component in FIG. 2A is simplified somewhat from the actual design, which was assembled from mostly off-the-shelf components: a ¼-28 polyetheretherketone (PEEK) Tee, a short piece of PEEK tubing, a fluorinated ethylene-propylene (FEP) sleeve for holding the Pt wire, as well as a few ferrules and PEEK fittings, all from Upchurch. A PEEK bulkhead union (⅜-24 external and ¼-28 internal threads) was modified slightly by removing the internal threads in the lower section so that the corona discharge plasma would be farther from the plastic. The tip of the Pt wire resides in this lower section and was positioned 3 mm above a stainless steel disk (0.5 mm thick) with a 0.4 mm diameter hole in the center. The platinum wire was sharpened to a point (~10 μm) using a rotary grinder followed by polishing with 3 μm alumina powder. This corona discharge electrode was provided at a large negative potential with respect to the stainless steel aperture disk using a high voltage power supply (Stanford Research Systems) and a 22 MΩ current-limiting resistor in series. The corona discharge voltage and current depended upon the gaseous medium; typical values were −3200 V and 25 μA in air or −2400 V and 60 μA in N2. After prolonged use, the aperture disks acquired a brown-black residue, as observed by others; consequently, they were designed for easy removal in order to polish or replace them. Having an aperture in this disk is a small modification to the conventional point-to-plane configuration of a corona discharge, and it allowed gas flow through the corona discharge, as discussed below.

The second charge reduction chamber (FIG. 2*b*) employed a 5 mCi $^{210}$Po α-particle source (Model P-2042, NRD, Grand Island, N.Y.). In this case, a large area of α-particle exposure was sometimes necessary, rather than a small aperture. Machining a larger hole in the stainless steel created a short (2.5 mm deep) but wide (18 mm dia.) cylindrical chamber for the interaction of anions with electrosprayed cations. Ion losses in this chamber may account for a somewhat lower signal intensity compared to the corona discharge CREMS source. Controlling the amount of charge reduction was accomplished by placing a 0.5 mm-thick stainless steel disk in front of the α-particle source; holes in the disks varied in size from 0.8 mm up to 14.5 mm yielding exposure areas from 0.2% up to 64%.

B.3. CREMS Source Operation

Since ESI of proteins is commonly performed in positive-ion mode, a "negative mode" corona discharge was utilized for anion generation. In general, a corona discharge ionizes the gaseous medium thereby creating a plasma that contains positive ions and free electrons. By holding the sharp tip at a negative potential, most positive ions are annihilated after following the intense electric field lines toward this cathode. The electrons travel in the opposite direction and some of them become "thermalized" from numerous collisions with molecules. Subsequently, these electrons may attach themselves to molecules, and in air the most frequent result is the $O_2^-$ ion because it is more stable than $N_2^-$. After chemical reactions in the plasma, other anionic species are sometimes produced as well (e.g. $O_3^-$, $NO_2^-$, $NO_3^-$, $CO_3^-$) depending on the gaseous medium. In fact, this sequence of events is what leads to ionization of solvent or analyte molecules during atmospheric-pressure chemical-ionization (APCI) mass spectrometry, which routinely employs a corona discharge.

The anions created by the corona discharge were transported through the disk aperture into the path of the electrosprayed ions, which were en route to the mass spectrometer inlet. A simple gas flow meter (Dwyer Instruments, Michigan City, Ind.) was used to change the flow rate of gas through this aperture, and thereby provide control over the amount of charge reduction. Adding a vapor to the flowing gas was accomplished by bubbling the air or nitrogen through the appropriate solvent. [Potential Hazard: while a corona discharge is unable to ignite the organic vapor in air, there is a small risk of electrical arcing. We were careful to obtain a stable corona before flowing in the organic vapor. Employing nitrogen gas instead of air ensures further safety, and it actually produces more favorable results, as shown in the Results section.]

B.4. Mass Spectrometry and Data Analysis

All experiments were conducted with a Mariner orthogonal acceleration time-of-flight (oa-TOF) mass spectrometer (Applied Biosystems). This ESI-TOF instrument provides reasonable mass accuracy, resolution, and a wide m/z range (50-25,000) for charge reduced protein spectra. All samples, regardless of whether charge reduction was performed, were electrosprayed from a fused silica capillary (90/20 μm o.d./i.d., Polymicro Technologies, Phoenix, Ariz.). The samples were infused at a flow rate of ~50 nL/min by employing positive air pressure, although a syringe pump would be suitable as well. The spray tip potential of ~2700 V was applied via a platinum wire immersed in the sample solution. Spectra of known proteins were obtained as ten co-added scans of 10 s each (unless otherwise noted). The cell lysate spectra were acquired as fifty co-added scans of 10 or 20 s each, without and with charge reduction, respectively.

Mass spectra were smoothed with Data Explorer software (Applied Biosystems); the number of data points used in the Gaussian smoothing algorithm was chosen to improve signal-to-noise without artificially broadening the peaks (3-99 points; always an equal number for spectra being directly compared). The Mariner instrument employs an ion counting detection method, and so the best quantitative measure is the sum of the ion counts for each data point across a peak. This ion count sum, was calculated for each charge state, z, using ProTS Data software (Efeckta Technologies, Steamboat Springs, Colo.). The total ion counts for a certain protein in a spectrum is given by:

$$A_{tot} = \sum_{z=1}^{n} A_z \tag{1}$$

where n is the highest charge state observed. The average charge state ( ) was calculated as a weighted average:

$$\bar{Z} = \sum_{z=1}^{n} z \cdot A_z / A_{tot} \tag{2}$$

The ion counts and average charge state values were corrected for the following known instrumental biases. (Note: the spectra shown in the figures are raw data, but the calculated results in data plots employed the corrections.) The first correction relates to a decrease in signal when the gas flow is increased through the corona discharge part of the nozzle extension. Forcing gas through this corona discharge sideport necessarily reduces the vacuum-induced flow coming from the electrospray region, which leads to somewhat fewer electrospray ions entering the mass spectrometer (refer to FIG. 2*a*). Control spectra were taken at each gas flow rate but without a corona discharge present. The $A_{tot}$ value for each of these control spectra was ratioed to $A_{tot}$ for the zero-flow spectrum to determine the fraction of ions lost for a given flow rate. The second type of correction corresponds to the preferential loss of faster-moving small ions in the orthogonal acceleration region of the spectrometer. The correction factor simply depends upon $(m/z)^{1/2}$. The last type of correction involves the m/z bias of the microchannel plate (MCP) detector. The efficiency with which an ion generates a secondary electron in the MCP has been shown to vary as follows:

$$\gamma e = C \cdot m \cdot v^{4.4} \tag{3}$$

where m is mass, v is velocity (calculated from the 4000 V acceleration potential), and C is a proportionality constant with a value of 10-24 and units that cancel the SI units of m and v to leave the unitless efficiency, γe. The strong velocity dependence (>4th power) means that slow-moving large m/z ions produce significantly fewer ion counts than smaller m/z ions.

C. Results and Discussion

C.1. Corona Discharge CREMS

Figure 3:
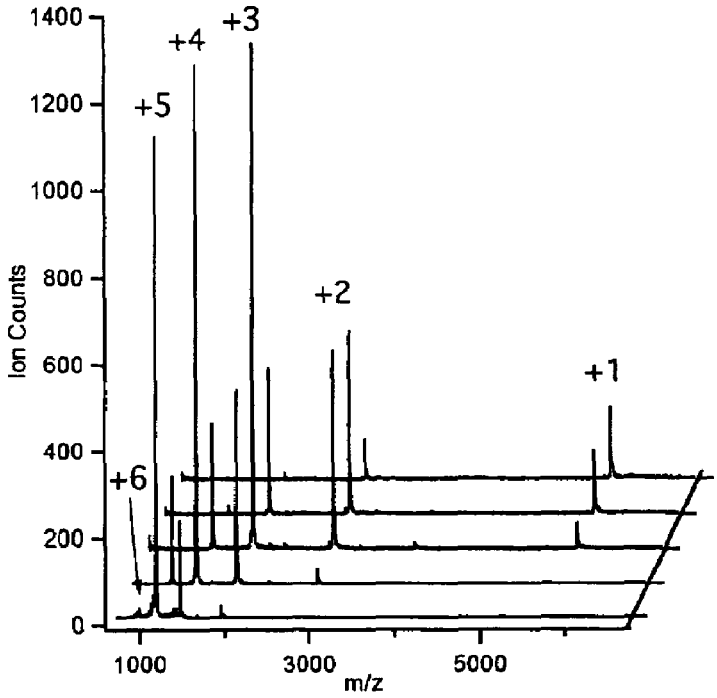
FIG. 3 displays a normal electrospray mass spectrum of insulin as well as several CREMS (charge reduction-electrospray mass spectrometry) spectra. These mass spectra of insulin show increasing amounts of charge reduction from front to rear. The front trace is a normal electrospray spectrum (10 s acquisition). The next trace is a CREMS spectrum with minimal charge reduction that was acquired in 20 s with a corona discharge gas flow rate of 10 mL/min. The remaining CREMS spectra show further charge reduction and were obtained in 100 s with gas flow rates of 35, 60, and 200 mL/min, respectively.

Application of the charge reduction technique to electrospray ions at atmospheric pressure allows a controllable shift to a lower charge state distribution. FIG. 3 displays a normal electrospray mass spectrum of insulin as well as several CREMS spectra. These mass spectra of insulin show increasing amounts of charge reduction from front to rear. The front trace is a normal electrospray spectrum (10 s acquisition). The next trace is a CREMS spectrum with minimal charge reduction that was acquired in 20 s with a corona discharge gas flow rate of 10 mL/min. The remaining CREMS spectra show further charge reduction and were obtained in 100 s with gas flow rates of 35, 60, and 200 mL/min, respectively.

As shown in FIG. 3, initially, charge states from +3 up to +6 are present, but charge reduction allows one to decrease these charges to the point where mostly +1 and +2 ions are observed. This change occurs because corona discharge generated anions abstract protons from the electrosprayed insulin ions, thereby reducing their charge.

Figure 4:
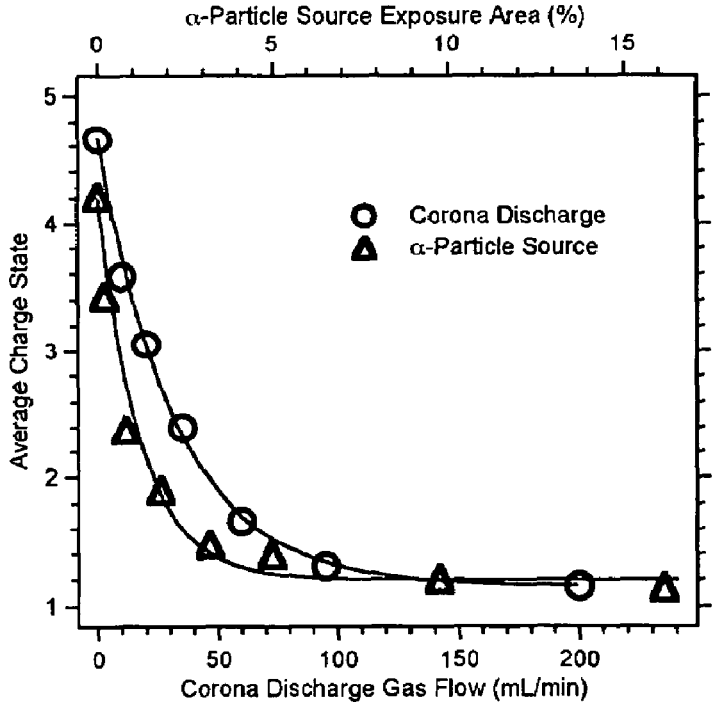
FIG. 4 shows a plot of the average charge state ($\bar{Z}$) of insulin, a measure of the charge state distribution, as a function of this gas flow (circles, bottom axis).

Changing the flow rate of gas through the corona discharge provides facile and reproducible control over the amount of charge reduction. As explained in the Experimental Section, anions such as $O_2^-$ are created by the corona discharge and then transported, via a gas stream through a small aperture, into the path of the electrosprayed ions (see FIG. 2*a*). FIG. 4 shows a plot of the average charge state ($\bar{Z}$) of insulin, a measure of the charge state distribution, as a function of this gas flow (circles, bottom axis). The triangles correspond to the percentage of the total area of the α-particle source that was exposed to the electrosprayed ions. Error bars are smaller than the data points. The curves shown are exponential fits to the data. A gas flow of zero yields a value of $\bar{Z}$=4.7 (this data point corresponds to a normal ESI spectrum such as the front trace in FIG. 3). Even though a corona discharge plasma is present, almost no charge reduction occurs without some gas flow through the aperture in the disk. As the flow rate increases, the average charge state decreases to where the +1 charge state predominates. For example, a gas flow rate of 200 mL/min gives a value of $\bar{Z}$=1.2, which corresponds to the rear trace in FIG. 3. It should be noted that completely charge neutralized ions (z=0) are not detected in mass spectrometry and therefore are not factored into the average charge state, which explains the asymptotic approach to $\bar{Z}$=1 instead of $\bar{Z}$=0. Nonetheless, it is clear from the circle data points in FIG. 4 that gas flow gives precise control over the amount of charge reduction. (Note: the α-particle source data in FIG. 4 is discussed later.)

Changing the gas flow through the corona discharge provides a convenient way of controlling the concentration of anions available to charge reduce electrosprayed ions via proton transfer reactions. In our configuration, reaction time is constant. It is fixed by the travel time through the field-free region of the corona discharge nozzle extension and the nozzle itself, which was calculated in the Experimental section to be ~10 ms. Charge reduction reactions terminate after this time period because the electric field in the nozzle-skimmer region separates the positive and negative ions. Consequently, control of this atmospheric pressure CREMS technique relies upon controlling the gas-phase anion density rather than the reaction time.

Anion production by corona discharge can occur in either a current-limiting or a space-charge-limiting regime. In previous work, a corona discharge shielded with wire mesh was located within the path of the electrosprayed ions, and charge reduction was controlled with an applied potential, which in turn varied the corona current (i.e. the current limiting regime). The alternate design presented here (FIG. 2*a*) removes the intense electric fields of the corona from the path of the electrosprayed ions and thereby leads to higher signal intensities and more stable corona discharges. With this configuration, varying the applied potential (above the corona onset voltage) produces no change in the amount of charge reduction and very little change in corona current. This behavior is indicative of a plasma with higher ion density where space-charge effects limit the anion density and keep it constant over time.

Flowing gas through this space-charge limited plasma is an effective method of controlling the anion concentration available for reaction with the protein cations. As shown in FIG. 4, the average charge state decays exponentially as a function of gas flow rate. This result is qualitatively consistent with pseudo-first-order kinetics:

$$[(M+zH)^{z+}] \approx [(M+zH)^{z+}]_0 e^{-kt[A^-]} \quad (4)$$

where $[(M+zH)^{z+}]$ is the protein cation concentration with the subscripted 0 indicating its initial concentration, k is the reaction rate constant, t is the time of reaction, and $[A^-]$ is the anion concentration (present in large excess to apply the pseudo-first-order assumption). The classical situation for pseudo-first-order kinetics is an exponential decay curve when reactant concentration is plotted as a function of time. In the present case, the results shown in FIG. 4 differ from this classical plot in two respects. First, the average charge state plotted on the y-axis is a composite quantity that reflects the gas-phase concentration of several different charge states, not just a single reactant species. Each of these charge states will exhibit differing reaction kinetics that depend upon the square of the charge state of the protein ion. Second, the plot in FIG. 4 shows the average charge state as a function of gas flow rate rather than as a function of reaction time. This difference is still consistent with Equation 4, since a similar exponential relationship is obtained with either time or anion concentration as the independent variable (where the other one is held constant). The exponential behavior observed thus suggests that the anion concentration depends linearly upon the gas flow rate, which seems reasonable because the gas flow simply moves anions from the plasma region into the reaction chamber. The results shown suggest strongly that pseudo-first-order kinetics give a good description of the behavior of this system, and that varying the gas flow through the corona discharge plasma does provide excellent control of the anion concentration and consequently the extent of charge reduction for electrosprayed protein ions.

C.2. Oxidation and Adduction Reactions

FIGS. 5A-5F provide mass spectra have identical axes showing the +1 charge state of insulin obtained with CREMS. As noted in the figure, various gases and vapors were flowed through the corona discharge source. In addition to the expected 5734.6 Da peak, spectra a, b, and c contain multiple peaks with approximately 16 Da spacing due to oxidation of the protein. These oxidation peaks are not present in spectrum d, but in that case nitrate adducts are observed with 63 Da spacing. Spectrum e shows that both oxidation and nitrate adduction are prevented by using methanol vapor in nitrogen gas. (f) An expanded view of the +4 charge state of insulin is shown in a different color to emphasize that it was obtained without charge reduction (5 s acquisition). Qualitatively, spectra e and f are nearly identical, which confirms that the spurious side reactions of CREMS have been eliminated.

The desired type of reaction during CREMS is proton transfer; other reactions will yield products with different masses and consequently decrease peak intensity. For instance, multiple peaks are observed in FIG. 5*a*, which shows an expanded view of the +1 charge state of insulin after charge reduction. Along with the expected peak at 5734.6 Da, additional peaks occur on the high mass side with an average spacing of 16 Da. The obvious culprit yielding this mass shift is an oxygen atom. Thus, it appeared that some species generated in the corona discharge plasma leads to oxidation of the protein. For analysis of protein mixtures by charge reduction, however, oxidation is merely a deleterious side reaction that decreases the desired signal and increases spectral complexity.

Figures 5A, 5B, 5C, 5D, 5E, 5F:
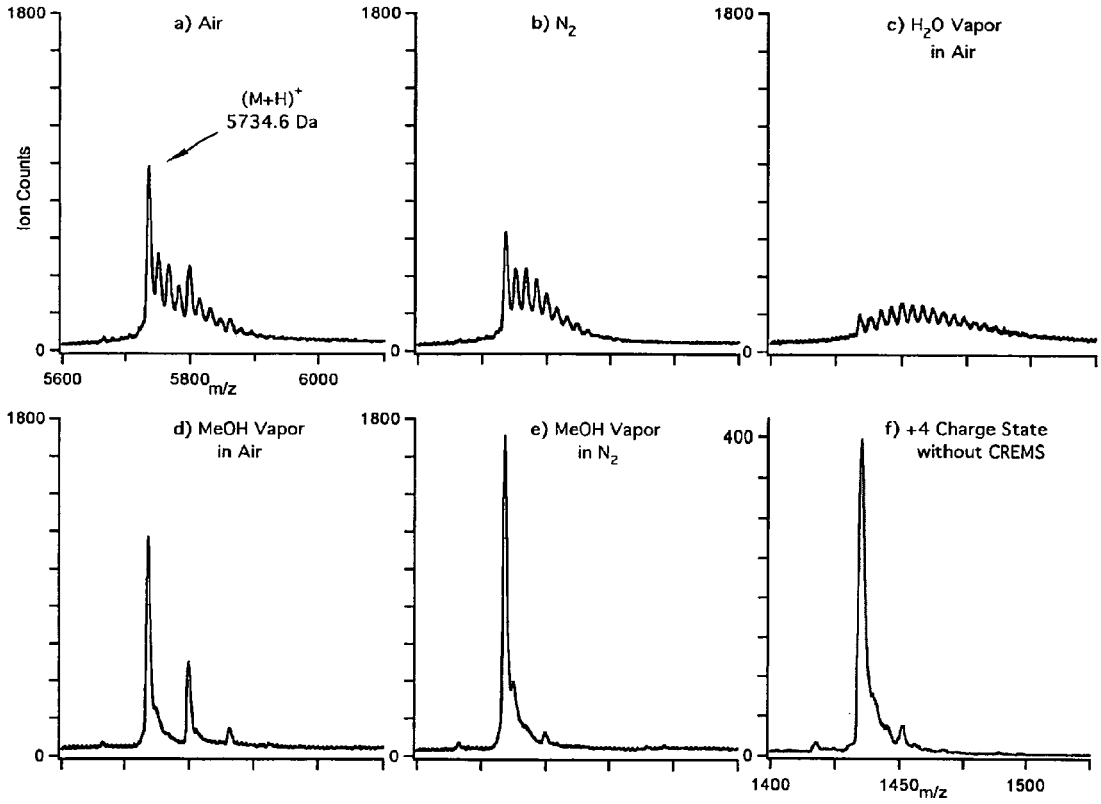
FIGS. 5A-5F provide mass spectra having identical axes showing the +1 charge state of insulin obtained with CREMS. As noted in the figures, various gases and vapors were flowed through the corona discharge source.

These oxidation reactions can be prevented by addition of an organic vapor to the gas stream flowing through the corona discharge. A logical first attempt at preventing oxidation employed nitrogen gas, rather than air, as both the corona discharge gas and as the electrospray atmosphere. Unfortunately, oxidation was as bad or worse under these conditions (see FIG. 5*b*), and similar results were observed for argon and carbon dioxide as well. Subsequently, various vapors were added to the gas stream flowing through the plasma in an attempt to produce species that are less reactive. As shown in FIGS. 5*c* and 5*d*, water vapor greatly increased the amount of oxidation, but methanol vapor eliminated it. Ethanol, acetonitrile, as well as a methanol/water vapor mixture all were as effective as methanol vapor at eliminating protein oxidation.

Despite solving the oxidation problem, methanol vapor in air still does not give the desired single peak for the charge reduced insulin spectrum due to adduction. The spectrum in FIG. 5*d* shows adduct peaks at M+63 and M+126; note that they are also observed in the absence of methanol vapor (FIG. 5*a*). The species forming these adducts is likely a 62 Da anion. In order to identify it, a negative ion mode spectrum was acquired when operating the corona discharge without performing electrospray. A strong peak at 61.983 Da was observed and identified as the nitrate anion ($NO_3^-$), which has a theoretical mass of 61.988 Da. Nitrate is known to form in corona discharges in air due to the combination of nitrogen and oxygen forming NO, which undergoes further oxidation to NO2 and eventually $NO_3^-$. When this nitrate anion collides with an electrosprayed protein ion, it might abstract a proton and leave as $HNO_3$ or it might form an adduct via ion attachment. Apparently adduct formation is more energetically favorable in this case; even raising the nozzle-skimmer potential to 400 V did not disrupt this adduct. A reasonable strategy for avoiding this particular adduct is to prevent nitrate from ever forming in the corona discharge by eliminating $O_2$. FIG. 5*e* shows the result from flowing methanol vapor in nitrogen gas through the corona discharge. This spectrum contains only very small peaks due to oxidation and nitrate adduction, and consequently the desired peak at 5734.6 Da is more intense than in the previous spectra (5*a*-5*d*). In fact the spectrum is essentially identical to that of insulin without charge reduction (FIG. 5*f*). Therefore, flowing an organic vapor in nitrogen gas through the corona discharge eliminates oxidation and adduction reactions in CREMS.

Figure 6:
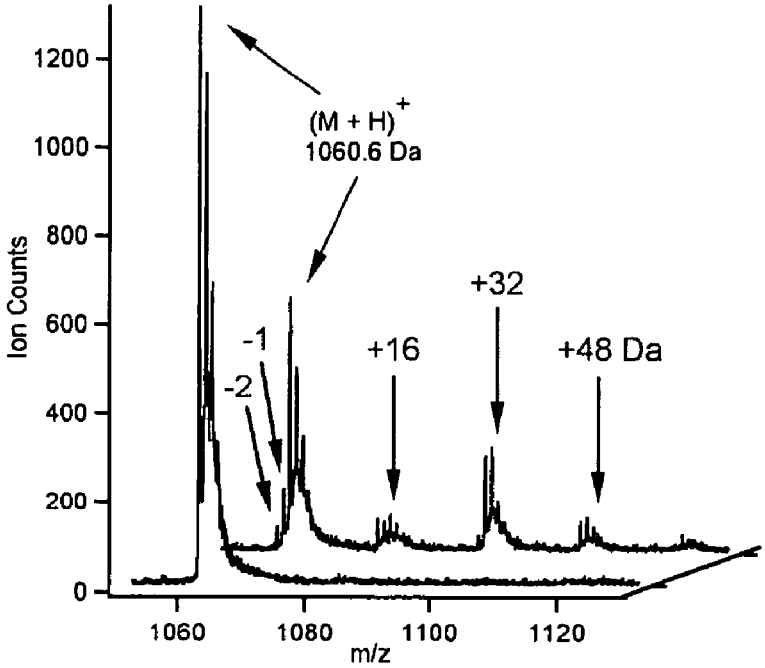
FIG. 6 shows two CREMS spectra obtained for the +1 charge state of bradykinin. The front trace displays a CREMS spectrum of the +1 charge state of bradykinin. The rear trace employed air instead, and consequently, it shows several peaks related to the reaction intermediates and products of oxidation.

To gain further insight into the oxidation reactions, similar experiments were performed with a smaller peptide, which yielded resolved isotope peaks of the charge-reduced ions. Normal electrospray of the nona-peptide bradykinin gives predominantly doubly charged ions, which CREMS converts to singly charged ions. FIG. 6 shows two CREMS spectra obtained for the +1 charge state of bradykinin. The front trace displays a CREMS spectrum of the +1 charge state of bradykinin. The spectrum reveals isotope peaks, but not oxidation or adduct peaks, because MeOH vapor in nitrogen gas was flowed through the corona discharge. The rear trace employed air instead, and consequently, it shows several peaks related to the reaction intermediates and products of oxidation. The rear trace in FIG. 6 exhibits a CREMS spectrum of bradykinin where the base peak is the monoisotopic peak at 1060.6 Da and the isotope peaks are resolved. As evidenced by the peak clusters at multiples of 16 Da, oxidation reactions are occurring, which is expected since no organic vapor was added to the gas flowing through the corona discharge. The most intriguing aspect of this spectrum is the appearance of peaks at one and two Daltons lower than the monoisotopic peak. These noteworthy peaks are absent from spectra obtained (i) without CREMS (not shown) and (ii) with CREMS employing methanol vapor to avoid oxidation (front trace in FIG. 6). Furthermore, the intensity of these peaks roughly scales with the amount of oxidation observed. Therefore, the species reacting with bradykinin to produce these peaks is quite likely related to the oxidation chemistry occurring in the CREMS source.

Observation of these noteworthy peaks along with results from the vapor studies leads us to believe that hydroxyl radical (.OH) is the agent responsible for oxidation during CREMS. The hydroxyl radical is one of the most potent gas-phase oxidizing species known and accounts for much of the destruction of organic compounds in the atmosphere. Since it is not an ion, .OH cannot be observed with mass spectrometry and so we will provide only indirect evidence of its existence. A common initial reaction between a hydroxyl radical and an organic compound involves abstraction of a hydrogen atom. A protein cation, for example, would undergo the following reaction:

$$RH^{z+}+.OH \rightarrow R^{z+}.+H_2O \quad (5)$$

The resulting radical cation quite possibly can exist at atmospheric pressure for a few milliseconds before entering the vacuum system, thereby explaining the loss of one Dalton observed in FIG. 6. In addition, the radical ion, $R^{Z+}$., may lose another hydrogen due to weakened bonds next to the radical site, which would form an alkene and explain the peak at −2 Da. Another intriguing aspect of the bradykinin spectrum is that the tallest oxidation related peaks occur at +31 and +32, as opposed to +16. This feature is also consistent with the known mechanism of hydroxyl radical induced oxidation in the atmosphere, namely attachment of $O_2$ to the radical:

$$R^{z+}.+O_2 \rightarrow RO_2^{z+}. \quad (6)$$

The $RO_2^{Z+}$. ion explains the prominence of the +31 mass shift, and this ion may undergo further reactions to yield various products such as an aldehyde (+14 Da), an alcohol (+16 Da), hydroperoxides (+32), and others. The mechanism proposed above pertains primarily to .OH attack in an alkyl region of the protein, but many other reactions are possible, notably reactions with aromatic, heterocyclic or sulfur-containing amino acid side-chains. These hydroxyl radical reactions appear consistent with several aspects of the bradykinin spectrum. Other than reaction with .OH, it is difficult to find a plausible scenario for loss of 1 Da from an electrosprayed peptide ion at atmospheric pressure, even though it is observed in vacuo with electron impact ionization.

Further indirect evidence for hydroxyl radical induced oxidation comes from the results of testing various vapors in the corona discharge. The likely source of .OH is water vapor via a reaction with a high-energy species produced in the corona discharge, such as the singlet-D oxygen atom:

$$O(^1D)+H2O \rightarrow 2.OH \quad (7)$$

In a typical experiment, the electrospray is the source of water vapor. Adding water vapor directly to the gas flowing through the corona discharge greatly increases the amount of oxidation (FIG. 5*c*), as expected from additional .OH being produced by Rxn 7. Conversely, organic vapors in the corona discharge, such as methanol, react with $O(^1D)$, or any other high-energy species, before it encounters the water vapor from the electrospray, thereby preventing hydroxyl radical formation and subsequent protein oxidation.

C.3. CREMS Comparison: Corona Discharge versus α-particle Source

Figure 7:
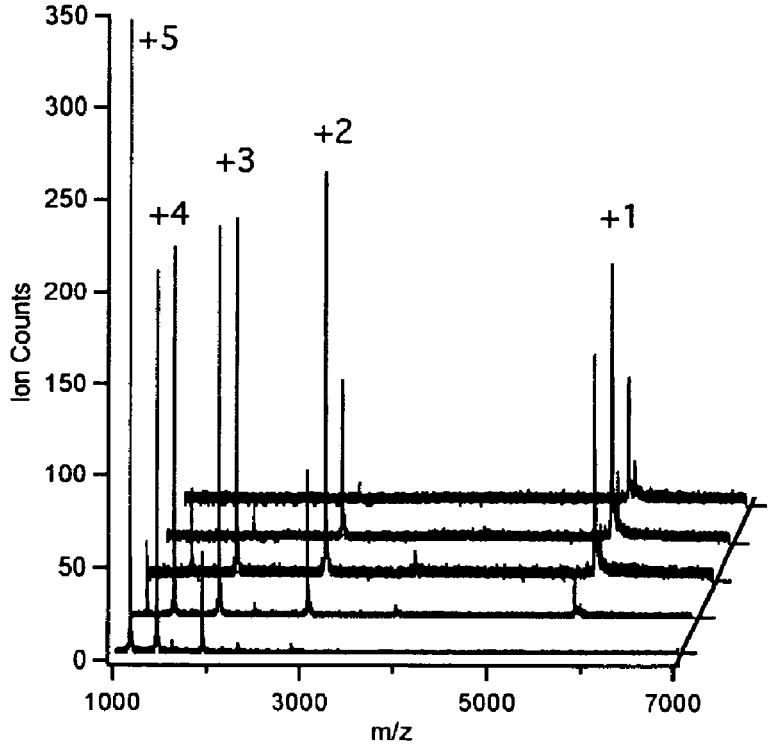
FIG. 7 displays several CREMS spectra of insulin obtained with a 210Po α-particle source, and they are quite similar to the corona discharge ones in FIG. 3. As in FIG. 3, the front trace was acquired in 10 s without charge reduction. The second trace is a CREMS spectrum obtained in 30 s using an α-particle exposure area of 0.8%. The remaining spectra employed exposure areas of 3.2%, 16%, and 65%, all with 100 s acquisition times. As demonstrated by the rear trace, a high α-particle exposure eliminates all but the +1 charge state.

Charge reduction of positive electrospray ions occurs easily with anions created by either a corona discharge or a radioactive α-particle source. FIG. 7 displays several CREMS spectra of insulin obtained with a 210Po α-particle source, and they are quite similar to the corona discharge ones in FIG. 3. As in FIG. 3, the front trace was acquired in 10 s without charge reduction. The second trace is a CREMS spectrum obtained in 30 s using an α-particle exposure area of 0.8%. The remaining spectra employed exposure areas of 3.2%, 16%, and 65%, all with 100 s acquisition times. As demonstrated by the rear trace, a high α-particle exposure eliminates all but the +1 charge state.

Interestingly, the α-particle source operating in an atmosphere of air does not give rise to oxidation peaks, but the nitrate adducts are present. Evidently these α-particles do not produce O(1 D) in air and the resulting hydroxyl radical-induced oxidation. However, some oxidation is observed when employing the α-particle source in a nitrogen atmosphere (data not shown). One possible explanation is that a high-energy nitrogen species is produced that usually reacts with $O_2$, but in its absence produces .OH from water vapor.

Control over the amount of charge reduction is accomplished by changing the area of the α-particle source exposed to the electrospray ions in the nozzle extension (refer to FIG. 2*b*). As shown in FIG. 4 (triangles, top axis), the average charge state of insulin is decreased by α-particle CREMS in a manner very similar to that by corona discharge (circles, bottom axis). It seems reasonable to assume that anion concentration in the chamber is directly proportional to the α-particle exposure area. Therefore, the exponential fit to the data again suggests pseudo-first-order kinetics of the ion/ion proton transfer reactions.

The α-particle source with a large exposure area has the potential to generate higher anion densities than the corona discharge. By comparing the most charge-reduced spectra between FIGS. 3 and 7, one will notice that the α-particle source can eliminate virtually all of the higher charge states leaving only +1 protein ions. The price for this result, however, is complete neutralization of many ions and consequently a smaller +1 peak than if some +2 ions were allowed to remain. In fact, using an α-particle exposure area of 100% completely neutralized all ions, leaving a mass spectrum devoid of peaks. Although corona discharge CREMS could employ an increased flow rate to achieve further charge reduction, the electrospray signal does decrease significantly when the corona gas flow rate approaches the intake rate of the vacuum system (~500 mL/min). Therefore, 200 mL/min is a reasonable upper limit that produces as many +1 ions as higher flow rates, but it does leave some +2 ions as well.

One explanation for why the α-particle source can produce a higher anion density is that it produces a bipolar neutralizing gas containing both positive and negative ions. On the other hand, the corona discharge is a predominately unipolar source of ions, and so anion density is limited by the space-charge effect mentioned earlier. Thus, the α-particle source has the advantage for very extensive charge reduction, but the corona discharge source is usually adequate and has some other advantages. For instance, it avoids the licensing and handling of radioactive materials as well as the gradual decrease in α-particle intensity over time (half-life of 210Po=138 days). Also, with the current designs the corona discharge gas flow provides more facile control over charge state distribution than the α-particle exposure area, especially when minimal charge reduction is desired.

C.4. Mass Discrimination

Despite the advantages of charge reduction of proteins, a possible problem involves the decreased signal intensity (refer to FIGS. 3 and 7). We have sought to determine the source of this signal fall-off that occurs with increasing m/z for CREMS. The two most likely possibilities are ion losses during the charge reduction process and instrumental biases affecting the transmission and detection efficiencies of different m/z ions (i.e. mass discrimination). Recently, our group ascertained that instrumental factors account completely for the mass fall-off observed in MALDI-TOF analysis of DNA oligomers. Unfortunately, it is more difficult to measure or model ion transmission through each component of an ESI-oaTOF instrument due to the transport of ions from atmospheric pressure to the vacuum system, and also the additional ion optics such as an RF-only quadrupole for collisional cooling. Nonetheless, the data were corrected using measurements and models that were either straightforward or deemed most significant from prior work.

Figure 8:
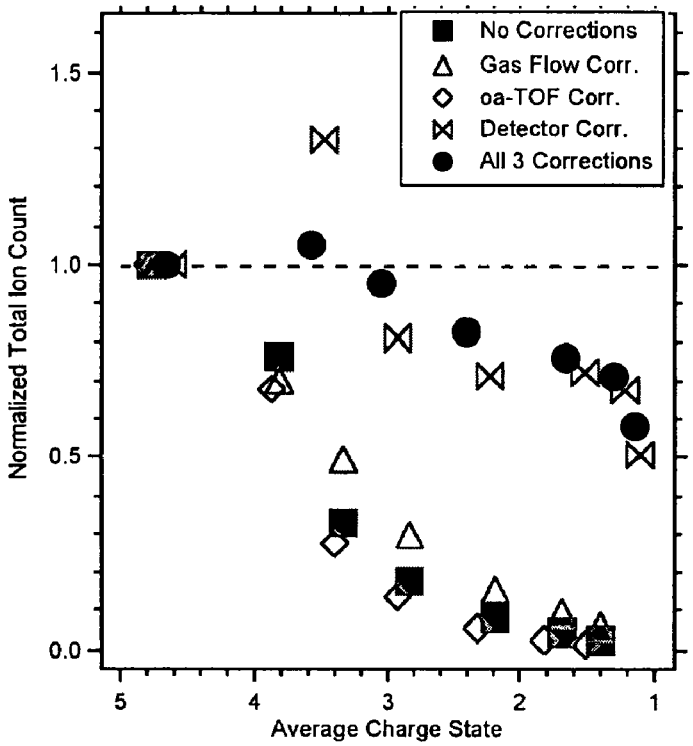
FIG. 8 provides a plot of the signal intensity is plotted versus the average charge state ($\bar{Z}$). The results of three individual corrections are shown as well as the combination of all three corrections. Each data point represents the sum of the ion counts from all of the charge states in a corona discharge CREMS spectrum of insulin. The data was normalized to the total ion count obtained without charge reduction (the leftmost data point).

Three types of signal intensity corrections were employed: gas flow rate, m/z bias in the orthogonal acceleration region of the TOF analyzer, and m/z bias of the microchannel plate (MCP) detector. FIG. 8 provides a plot of the signal intensity is plotted versus the average charge state ($\bar{Z}$). The results of three individual corrections are shown as well as the combination of all three corrections. Each data point represents the sum of the ion counts from all of the charge states in a corona discharge CREMS spectrum of insulin. The data was normalized to the total ion count obtained without charge reduction (the leftmost data point). The uncorrected data in FIG. 8 (squares) show that the total ion count does decrease dramatically as the average charge state is reduced by CREMS. Each of the three individual corrections is shown in the figure (see the Experimental section for quantitative details). Gas flow through the corona discharge nozzle extension tends to cause some ion losses except at very low flow rates, and so accounting for this effect generally increases the corrected ion count. The orthogonal acceleration into the time-of-flight drift tube always favors higher m/z ions, which means this oa-TOF correction decreases the corrected ion count of charge-reduced spectra. The MCP detector is much less efficient for the high m/z ions in the CREMS spectra, as indicated by the large change in ion count when applying this detector correction.

Applying all three of the corrections to the data results in a much higher normalized total ion count (circles in FIG. 8). The dashed line gives a visual representation of the expected signal if no ion losses or instrumental biases occurred. The corrected data follow the dashed line initially but then fall away from the line with more extensive charge reduction. This trend is expected since an increasing number of ions are completely neutralized and thereby avoid detection. The approximate agreement between the corrected data and the expected signal suggests that we have accounted for the largest factors influencing the ion count from CREMS. However, changing the quadrupole RF amplitude or nozzle potential also impacts the transmission efficiency of various m/z ions, and so the above results are not complete quantitative corrections for mass discrimination. Nonetheless, it is quite apparent that the inefficiency of the MCP detector at higher m/z values leads to the majority of the signal decrease occurring with charge reduction. The relatively low acceleration potential of 4000 V for the Mariner spectrometer used in this work exacerbates this detector inefficiency issue. Increased acceleration would provide significant signal enhancement for the charge-reduced ions because the detection efficiency of the MCP depends upon the ion velocity to about the fourth power (refer to Equation 3). Most other TOF instruments employ a higher acceleration potential than the Mariner, or alternatively one could institute "post acceleration" after the mass analyzer. The data in FIG. 8 demonstrate that most of the observed CREMS signal decrease is due to mass discrimination of the detector rather than ion losses caused by the CREMS source or by complete neutralization.

C.5. CREMS of a Protein Sample Isolated from *E. coli*

Figure 9A:
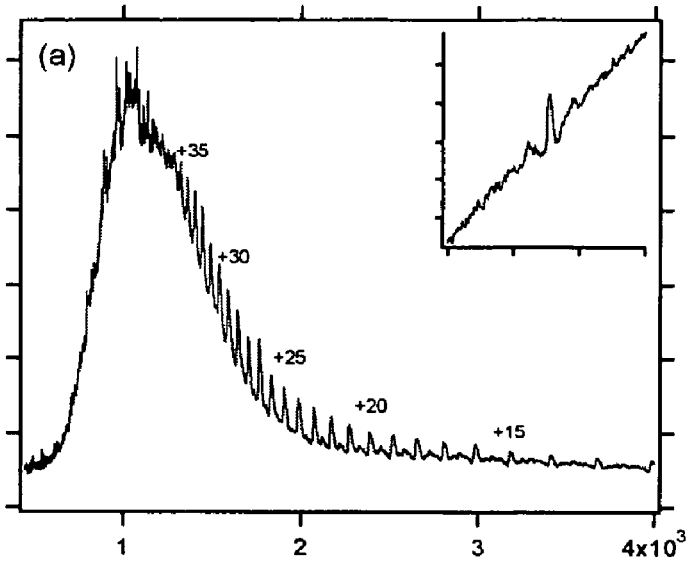
FIGS. 9A-9C provide mass spectra corresponding to a protein sample isolated from *E. coli*. (9A) Mass spectrum obtained without charge reduction. (The inset shows the deconvolution spectrum with a small peak at 47.8 kDa—note that all three insets are plotted from 40 to 55 kDa). (9B) Corona discharge CREMS in air (deconvolution peak at 49.2 kDa). (9C) Corona discharge CREMS with MeOH vapor in N2 (deconvolution peak at 48.0 kDa). The red arrows indicate proteins not observed without CREMS.
Figure 9B:
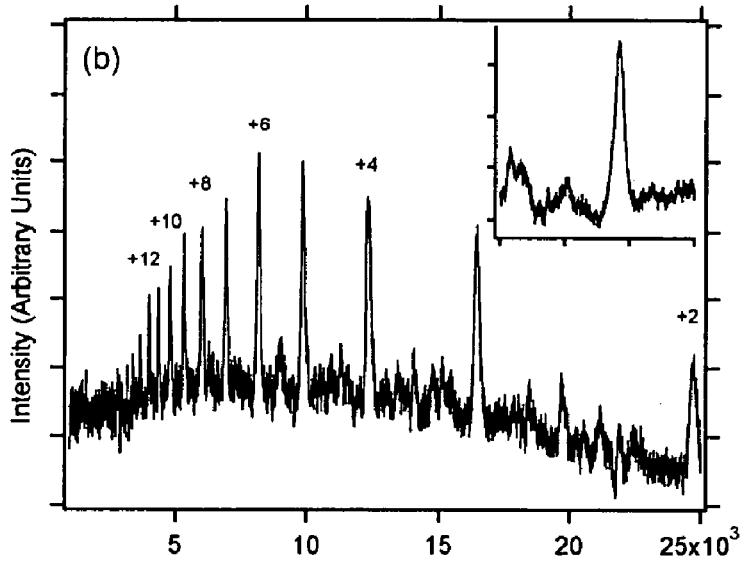
Figure 9C:
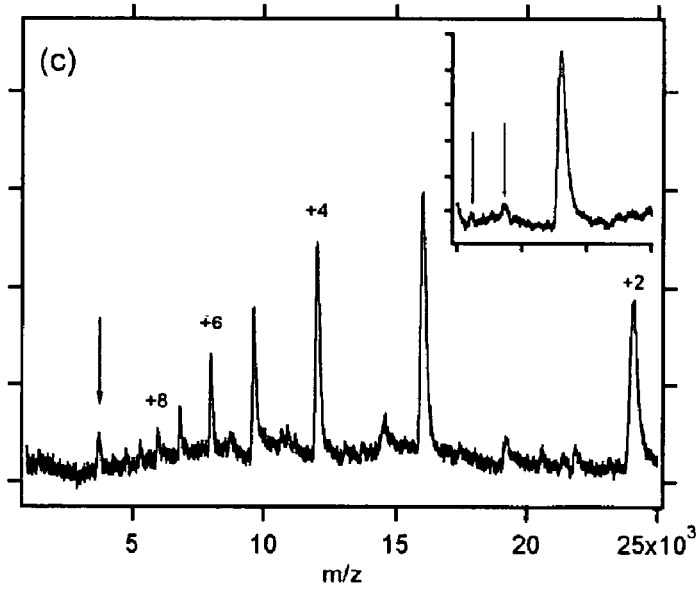

The insights and improvements to CREMS gained from the above studies have been applied to a real biological sample. A fraction that resulted from first ion-exchange and then reverse-phase separation of intact proteins from a whole cell lysate of *E. coli* was obtained from Dave Robinette and Morgan Giddings. FIGS. 9A-9C provide mass spectra corresponding to a protein sample isolated from *E. coli*. (9A) Mass spectrum obtained without charge reduction. (The inset shows the deconvolution spectrum with a small peak at 47.8 kDa—note that all three insets are plotted from 40 to 55 kDa). (9B) Corona discharge CREMS in air (deconvolution peak at 49.2 kDa). (9C) Corona discharge CREMS with MeOH vapor in N2 (deconvolution peak at 48.0 kDa). The red arrows indicate proteins not observed without CREMS.

FIG. 9*a* provides normal ESI spectrum of the sample. A poor spectrum such as this one is typical for an inhomogeneous protein sample obtained using electrospray with a bench top mass spectrometer. One does observe in FIG. 9*a* some resolved charge state peaks that produce a small peak in the deconvolution spectrum (see inset). In contrast, charge reduction yields completely resolved charge state peaks and more pronounced peaks in the deconvolution spectra (FIGS. 9B and 9C).

As discussed above, employing methanol vapor in nitrogen gas for the corona discharge CREMS improves the resulting spectra. First, a better signal-to-noise ratio is observed in FIG. 9C (MeOH vapor in N2) compared to FIG. 9B where the corona discharge occurred in air. Second, a more accurate mass is obtained; the corona discharge in air leads to oxidation and adduction reactions that shift the main peak in the deconvoluted spectrum by more than one kilodalton (49.2 versus 48.0 kDa).

This *E. coli* fraction appears to contain predominantly one protein, but actually a few other proteins are present. The normal ESI spectrum reveals only the 48 kDa protein. The CREMS spectrum, however, shows a few additional peaks. The peak at 3710 m/z is likely due to a small protein that has been charge reduced to +1. Other small peaks in FIG. 9C yield the small features at 41.2 and 43.6 kDa in the inset. In an effort to learn more about this sample, a MALDI-TOF spectrum was acquired (not shown). By far the most prominent peaks were due to the +1 and +2 charge states of a 48.1 kDa protein, which matches the CREMS results quite well. In addition, small peaks were observed at 43.6 and 53.0 kDa. Thus, the MALDI results confirm the presence and measured mass of two proteins observed by CREMS. But also, each technique found a protein or two absent in the results from the other, which is not uncommon with the somewhat complementary ionization mechanisms of MALDI and electrospray.

D. Conclusions

Charge reduction has been performed on electrosprayed protein mixtures in order to simplify the mass spectra. This technique revealed additional proteins in a sample derived from *E. coli* by both decreasing the number of charge state peaks for each protein as well as spreading them across a wider m/z range. The extent of the charge reduction reactions was easily controlled by varying the anion concentration supplied to the electrosprayed protein cations. This anion density was determined either by the flow rate of gas through the corona discharge or by the exposed area of the α-particle source. Flowing nitrogen gas containing an organic vapor through the corona discharge source prevented undesired oxidation and adduction reactions by avoiding the formation of hydroxyl radicals and nitrate ions. The inefficiency of the MCP detector for higher-m/z ions was the major cause of the decreased signal intensity for charge-reduced spectra, whereas ion losses within the CREMS source or from neutralization appeared to be minimal. Charge reduction electrospray mass spectrometry at atmospheric pressure with the current nozzle extension design reduces spectral complexity for mixtures of intact proteins.

EXAMPLE 2

Charge Reduction Ion Trap Studies

The present invention provides versatile ion generation methods and devices that are compatible with a range of ion collection, analysis and detection systems. To exemplify this quality of the present invention, a charge reduction ion source of the present invention was directly interfaced with an ion trap mass spectrometer. The mass spectra acquired demonstrate that methods and devices of the present invention provide an efficient source of ions having a controlled extent of charge state reduction to an ion trap mass analyzer. In addition, the results show that ion sources of the present invention are capable of generating mass spectra with enhanced peak-to-peak separation relative to conventional ion sources.

The mass spectra of a sample containing a BSA (bovine serum albumin) tryptic peptide (MW=1419.5 amu) having the amino acid sequence SLHTLFGDELCK was determined using a conventional electrospray ionization ion source and a charge reduction ion source of the present invention. The charge reduction ion source was used to generate analyte ions having a lower charge state distribution relative to the charge state distribution of ions generated by the conventional electrospray ionization ion source. The sample evaluated was isotopically labeled and characterized by an $^{16}O$ to $^{18}O$ isotope ratio equal to 3:1. For both ion sources, an ion trap mass analyzer was used for ion analysis and detection.

Figure 10A:
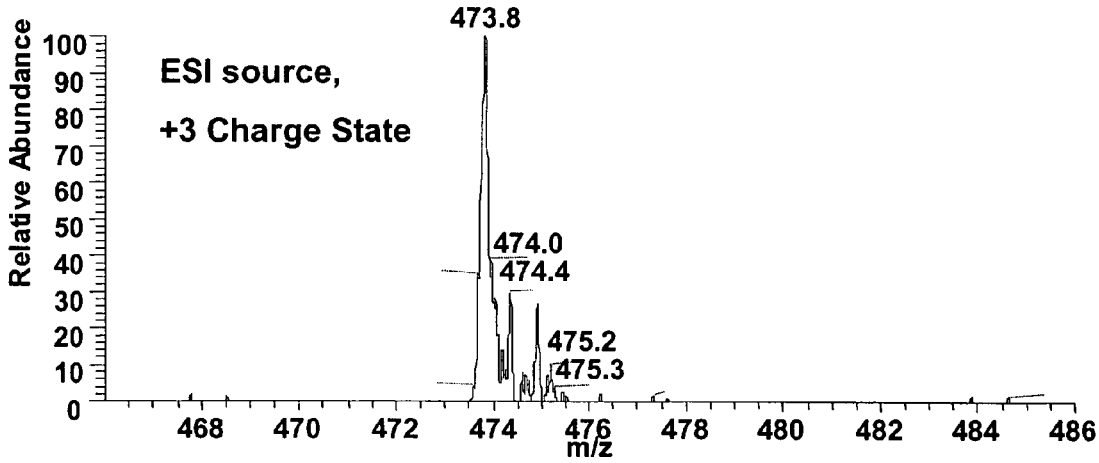
FIG. 10A shows a mass spectrum corresponding to peptides principally having a +3 charge state generated using the conventional electrospray ionization source.
Figure 10B:
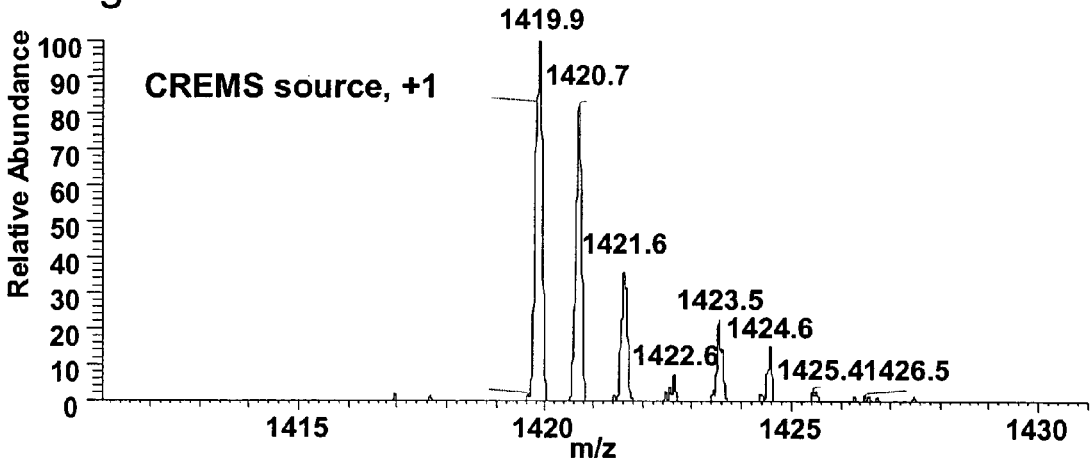
FIG. 10B shows a mass spectrum corresponding to peptides principally having a +1 charge state generated using the present charge reduction ion source.

FIG. 10A shows a mass spectrum corresponding to peptides principally having +3 charge states generated using the conventional electrospray ionization source. FIG. 10B shows a mass spectrum corresponding to peptides principally having a +1 charge state generated using the present charge reduction ion source. As shown in FIG. 10A, $^{16}O$ and $^{18}O$ isotopic peaks are spaced close to each other and, hence, very difficult to resolve. In contrast, $^{16}O$ and $^{18}O$ isotopic peaks of the +1 charge state peptides shown in FIG. 10B are clearly separated, and thus, easily resolvable.

The results of this example demonstrate that charge reduction ion sources of the present invention are capable of effective integration with ion trap mass analyzers. Hence, the present invention includes ion trap mass spectrometers having a charge reduction ion source. Moreover, reduction of the charge state of the peptides analyzed provides a means of enhancing the peak-to-peak separation. In some embodiments, for example, reducing the charge state distributions of ions analyzed provides a means of spreading the peaks in a mass spectrum over a wider m/z/range. As shown by a comparison of FIGS. 10A and 10B, the result is a much better quantitative measurement of the ratio of $^{16}O$ to $^{18}O$ labeled peptide (ratio was 3:1).

EXAMPLE 3

Nozzle Extension—Charge Reduction Chamber

The present invention includes ion sources for a mass spectrometer having a charge reduction chamber provided as a nozzle extension. In this embodiment, the nozzle extension-charge reduction chamber is provided in fluid communication with an electrospray ion source (or other source of analyte ions such as a nebulizer source) and directly interfaced with the nozzle (i.e. the inlet of the mass spectrometer) or equivalent inlet component of a mass spectrometer. Analyte ions are generated by the electrospray source, conducted through the nozzle extension-charge reduction chamber wherein they undergo controlled charge reduction and are directly transported through the nozzle of the mass spectrometer. In this embodiment, the nozzle extension is positioned and held at an electric potential for promoting formation of the electrospray (i.e. establishes the necessary potential difference between the sample discharged and the surface of the nozzle extension proximate to the electrospray). Use of nozzle extension-charge reduction chambers provides enhanced analyte ion transmission efficiency (i.e. reduced analyte ion losses) in the nozzle extension-charge reduction chamber, as compared to other charge reduction chamber geometries.

Direct coupling of the nozzle extension-charge reduction chamber and the nozzle of the mass spectrometer may be provided by any means known in the art. Use of an o-ring seal or gasket connection (or any other equivalent) for directly interfacing these components is beneficial for providing a flow of analyte ions through the nozzle extension by pumping through the nozzle of the mass spectrometer. Conducting ions into the mass spectrometer via direct pumping provides an efficient means of transporting ions through the charge reduction chamber and into a mass spectrometer with low ion losses, particularly for nozzle extension-charge reduction chambers having relatively small volumes (e.g. less than about 10 $cm^3$). In addition, direct coupling of nozzle extension-charge reduction chambers entirely avoids the need for large external bath gas flows to conduct ions through the charge reduction chamber and into the mass spectrometer. Such large flows of bath gas can lead to unwanted analyte ion losses by deposition to the walls of the charge reduction chamber.

Selection of appropriate geometries and physical dimensions of nozzle extension-charge reduction chambers of the present invention is important for ensuring that the desired extent of charge reduction is achieved and that ions are effectively transported to the mass spectrometer. The physical dimensions and geometry of useful nozzle extension-charge reduction chambers depends, at least in part, on a number of interconnected variables including: (i) the volume of the nozzle extension, (ii) the length the nozzle extension extends along the translational axes of the analyte ions, (iii) the inlet and outlet dimensions of the nozzle extension, and (iv) the linear flow rate of analyte ions through the nozzle extension. The chief, but not sole, consideration of these interrelated parameters is the reaction time provided between the electrosprayed ions and the reagent ions. Under some experimental conditions the reaction time is approximately equal to the residence time of analyte ions in the nozzle extension-charge reduction chamber. In some embodiments, design parameters are selected such that a reaction time of about 10 milliseconds is provided. Shorter reactions times, for example, ranging from about 2 milliseconds to about 9 milliseconds are also useable but require higher reagent ion concentrations to achieve significant charge reduction. Longer reaction times, for example, up to several hundred milliseconds, are also useable in the present invention. However, signal losses may increase under these conditions due to diffusion and subsequent collision of analyte ions with the walls of the nozzle extension-charge reduction chamber. This may be remedied, however, by applying voltages within the chamber creating an ion guide effect.

Calculation of the residence time in the nozzle extension depends on the vacuum-induced flow rate going through the inlet of the mass spectrometer and also upon the diameter and length of the nozzle extension-charge reduction chamber. For the Mariner instrument (See, Example 1) the flow through the inlet is about 20 $cm^3$ $s^{-1}$ and the chamber diameter and length were 2.5 mm and 42 mm, respectively. These values provide a residence time in the nozzle extension-charge reduction chamber of about 10 ms. Larger inlet dimensions and/or larger pressure differences (provided by more efficient pumping) may be employed providing an inlet flow of up to about 100 $cm^3$ $s^{-1}$; then maintaining the 10 ms residence time requires a chamber 5×longer or 2.2×bigger in diameter (as the radius is squared in the calculation, See Example 1). In the present invention the reaction time may be selected over a range of values, for example from about 10 millisecond to about 100 milliseconds. This requires a chamber 10×longer or 3.2×bigger in diameter. Combining these two scenarios (factors of 5 and 10) yield an upper limit for chamber length of 50×42=2000 mm, with preferred values equal to or less than 500 mm. Alternatively this factor of 50 could come from a 17 mm diameter chamber, which is acceptable. Arriving at a lower limit for dimensions of the chamber follow a similar line of reasoning, but would run up against practical physical limitations, such as chamber diameter of 0.25 mm and a length of 1 mm.

Another way to increase the residence time is to have a smaller outlet orifice for the nozzle extension-charge reduction chamber than the internal diameter of the main part of the nozzle extension-charge reduction chamber. Note that length divided by linear flow velocity yields residence time (e.g. Mariner example 4 cm divided by 390 cm $s^{-1}$ gives the 10 ms). As discussed above the practical lengths are between 0.1 cm and 50 cm. So, the longest time (e.g. 200 ms) with the shortest length (e.g. 0.1 cm) yields a linear flow velocity of 0.5 cm $s^{-1}$ and at the other extreme 2 ms and 50 cm yields a linear flow velocity of 25,000 cm $s^{-1}$. These values of the linear flow velocity provide useful limits of 0.5 to 25,000 cm $s^{-1}$ useful in practicing the present invention The lower limit is not very different from a gas mixture just sitting and reacting, and the upper limit is reasonable because this velocity is about the velocity through mass spectrometer inlets generally.

We claim:

1. An ion source for preparing analyte ions from a liquid sample containing a carrier liquid, said ion source comprising:

an electrically charged droplet source for generating electrically charged droplets from the liquid sample, wherein at least partial evaporation of said carrier liquid from the electrically charged droplets generates analyte ions;

a charge reduction chamber in fluid communication with the electrically charged droplet source, said charge reduction chamber provided as a chamber separate from said electrically charged droplet source and positioned for receiving and reducing the charge of the electrically charged droplets, analyte ions, or both; and a charge reduction reagent ion source in fluid communication with said charge reduction chamber and positioned outside of said charge reduction chamber, said charge reduction reagent ion source comprising:

a means for generating a flow of a precursor gas; and a means for generating reagent ions from said precursor gas, wherein said flow of precursor gas passes through said means for generating reagent ions, thereby generating reagent ions which are transported into said charge reduction chamber and react with electrically charged droplets, analyte ions or both in the charge reduction chamber to change the charge-state distribution of the analyte ions;

wherein said means for generating a flow of a precursor gas is selectively adjustable to control the charge-state distribution of said analyte ions.

2. The ion source of claim 1 wherein said means for generating reagent ions is selected from the group consisting of:

a corona discharge an arc discharge;

a plasma;

a thermionic electron gun;

a microwave discharge;

an inductively coupled plasma;

a radio frequency corona discharge;

a source of electromagnetic radiation; and a radioactive source.

3. The ion source of claim 1 wherein said charge reduction reagent ion source is positioned directly adjacent to said charge reduction chamber.

4. The ion source of claim 1 wherein said means for generating reagent ions from said precursor gas is a corona discharge comprising a first electrically biased element and a second electrically biased element, wherein said first electrically biased element and said second electrically biased element are held at a selected potential difference and separated by a distance close enough to create a self-sustained electrical gas discharge, and wherein said second electrically biased element provides an interface between said reagent ion source and said charge reduction chamber.

5. The ion source of claim 4 wherein said second electrically biased element has an aperture that allows reagent ions, precursor gas or both to flow from said charge reduction reagent ion source into said charge reduction chamber.

6. The ion source of claim 5 wherein said aperture has an area selected from the range of about 0.1 $mm^2$ to about 10 $mm^2$.

7. The ion source of claim 5 wherein said first electrically biased element is a wire electrode and said second electrically biased element is a plate having said aperture.

8. The ion source of claim 4 wherein said selected potential difference is selected from the range of approximately 10,000 V to approximately −10,000 V.

9. The ion source of claim 1 wherein said precursor gas is selected from the group consisting of:

air;

nitrogen ($N_2$);

carbon dioxide ($CO_2$);

argon (Ar);

sulfur hexafluoride ($SF_6$);

helium (He); and oxygen ($O_2$).

10. The ion source of claim 1 wherein said a means for generating a flow of a precursor gas is selectively adjustable to adjust the flow rate of precursor gas through the means for generating reagent ions or the flow rate of reagent ions, precursor gas or both into the charge reduction chamber.

11. The ion source of claim 1 wherein reaction of said reagent ions with said analyte ions reduces the charge state distribution of said analyte ions.

12. The ion source of claim 1 further comprising a means for generating a flow of a scavenging gas that passes through said means for generating reagent ions and wherein said scavenging gas reacts with reagent ions or other reactive chemical species that oxidize or form adducts with said analyte ions.

13. The ion source of claim 12 wherein said scavenging gas is selected from the group consisting of:

methanol;

ethanol;

acetonitrile; and a mixture of methanol and water.

14. A method of generating analyte ions having a selected charge state distribution from a liquid sample containing a carrier liquid, said method comprising the steps of:

producing a plurality of electrically charged droplets of the liquid sample using an electrically charged droplet source, wherein at least partial evaporation of carrier liquid from said electrically charged droplets generates analyte ions;

passing the electrically charged droplets, analyte ions or both through a charge reduction chamber wherein said charge reduction chamber is provided as a chamber separate from the electrically charged droplet source;

exposing the droplets, analyte ions or both to reagent ions generated from a charge reduction reagent ion source in fluid communication with said charge reduction chamber and positioned outside of said charge reduction chamber, said charge reduction reagent ion source comprising a means for generating a flow of a precursor gas; and a means for generating reagent ions from said precursor gas;

wherein said flow of precursor gas passes through said means for generating reagent ions, thereby generating reagent ions which are transported into said charge reduction chamber and react with electrically charged droplets, analyte ions or both in the charge reduction chamber to reduce the charge-state distribution of the analyte ions, thereby generating said analyte ions having a selected charge state distribution.

15. The method of claim 14 further comprising the step of controlling the charge state distribution of said analyte ions by selectively adjusting the flow rate of precursor gas through the means for generating reagent ions or by selectively adjusting the flow rate of reagent ions, precursor gas or both into the charge reduction chamber or both.

16. The method of claim 14 further comprising the step of controlling the charge state distribution of said analyte ions by selectively adjusting the residence time of charged droplets, analyte ions or both in the charge reduction chamber.

17. The method of claim 14 wherein reaction between said reagent ions and analyte ions reduces the charge state distribution of said analyte ions.

18. A device for determining the identity or concentration of chemical species in a liquid sample containing the chemical species in a carrier liquid, said device comprising:

an electrically charged droplet source for generating electrically charged droplets from the liquid sample, wherein at least partial evaporation of said carrier liquid from the electrically charged droplets generates analyte ions;

a charge reduction chamber in fluid communication with the electrically charged droplet source, said charge reduction chamber provided as a chamber separate from said electrically charged droplet source and positioned for receiving and reducing the charge of the electrically charged droplets, analyte ions or both;

a charge reduction reagent ion source in fluid communication with said charge reduction chamber and positioned outside of said charge reduction chamber, said charge reduction reagent ion source comprising a means for generating a flow of a precursor gas; and a means for generating reagent ions from said precursor gas, wherein said flow of precursor gas passes through said means for generating reagent ions, thereby generating reagent ions which are transported into said charge reduction chamber and react with electrically charged droplets, analyte ions or both in the charge reduction chamber to change the charge-state distribution of the analyte ions; wherein said means for generating a flow of a precursor gas is selectively adjustable to control the charge-state distribution of said analyte ions; and a charged particle analyzer in fluid communication with said charge reduction chamber, for receiving and analyzing said analyte ions.

19. The device of claim 18 wherein said charge particle analyzer is a mass analyzer selected from the group consisting of:

a time of flight mass spectrometer;

an ion trap;

a quadrupole mass spectrometer;

a Fourier transform ion cyclotron resonance mass spectrometer;

an ion mobility spectrometer;

a differential mobility analyzer;

a tandem mass spectrometer; and residual gas analyzer.

20. A method for determining the identity or concentration of chemical species in a liquid sample containing the chemical species in a carrier liquid, said method comprising:

producing a plurality of electrically charged droplets of the liquid sample using an electrically charged droplet source, wherein at least partial evaporation of carrier liquid from said electrically charged droplets generates analyte ions;

passing the electrically charged droplets, analyte ions or both through a charge reduction chamber wherein said charge reduction chamber is provided as a chamber separate from the electrically charged droplet source;

exposing the droplets, analyte ions or both to reagent ions generated from a charge reduction reagent ion source in fluid communication with said charge reduction chamber and positioned outside of said charge reduction chamber, said charge reduction reagent ion source comprising a means for generating a flow of a precursor gas; and a means for generating reagent ions from said precursor gas; wherein said flow of precursor gas passes through said means for generating reagent ions, thereby generating reagent ions which are transported into said charge reduction chamber and react with electrically charged droplets, analyte ions or both in the charge reduction chamber to reduce the charge-state distribution of the analyte ions, controlling the charge-state distribution of said analyte ions by selectively adjusting the flow rate of precursor gas through the means for generating reagent ions, the flow rate of reagent ions, precursor gas or both into the charge reduction chamber or both; and analyzing said analyte ions with a charged particle analyzer, thereby determining the identity or concentration of said chemical species.

21. An ion source comprising:

a nozzle extension-charge reduction chamber having an inlet in fluid communication with a source of analyte ions and an outlet interfaced with the nozzle of a mass spectrometer, said nozzle extension-charge reduction chamber provided as a separate chamber from the source of analyte ions, wherein pumping by said mass spectrometer transports said analyte ions through said nozzle extension - charge reduction chamber; and a charge reduction reagent ion source in fluid communication with said nozzle extension-charge reduction chamber and positioned outside of said nozzle extension - charge reduction chamber for receiving and reducing the charge of said analyte ions.

22. The ion source of claim 21 wherein said charge reduction reagent ion source comprises a means for generating a flow of a precursor gas; and a means for generating reagent ions from said precursor gas, wherein said flow of precursor gas passes through said means for generating reagent ions, thereby generating reagent ions which are transported into said nozzle extension-charge reduction chamber and react with said analyte ions to reduce the charge-state distribution of the analyte ions.

* * * * *

UNITED STATES PATENT AND TRADEMARK OFFICE

CERTIFICATE OF CORRECTION

PATENT NO. : 7,518,108 B2
APPLICATION NO. : 11/272450
DATED : April 14, 2009
INVENTOR(S) : Frey et al.

It is certified that error appears in the above-identified patent and that said Letters Patent is hereby corrected as shown below:

In the Claims:

In claim 10, column 34, line 63, replace "said a means" with --said means--.

Signed and Sealed this
Sixteenth Day of July, 2013

Teresa Stanek Rea

Teresa Stanek Rea
*Acting Director of the United States Patent and Trademark Office*